US008376157B2

(12) United States Patent
Jarvis et al.

(10) Patent No.: US 8,376,157 B2
(45) **Date of Patent: *Feb. 19, 2013**

(54) SCALABLE SHELVING SYSTEM

(75) Inventors: Charles W. Jarvis, Irvine, CA (US); Johannes Le, Huntington Beach, CA (US); Fred Gates, El Camino Village, CA (US); Jorge Baez, Lake Forest, CA (US); Herbert Hense, Warstein (DE)

(73) Assignee: Cambro Manufacturing Company, Huntington Beach, CA (US)

( * ) Notice: Subject to any disclaimer, the term of this patent is extended or adjusted under 35 U.S.C. 154(b) by 174 days.

This patent is subject to a terminal disclaimer.

(21) Appl. No.: 12/762,534

(22) Filed: Apr. 19, 2010

(65) Prior Publication Data

US 2011/0253658 A1 Oct. 20, 2011

(51) Int. Cl.
*A47B 43/00* (2006.01)
*A47B 47/00* (2006.01)
*A47B 9/00* (2006.01)

(52) U.S. Cl. ..... 211/187; 211/191; 108/147.12; 108/147.16

(58) Field of Classification Search ..... 211/189–192, 211/194, 175, 207, 186, 187, 188; 403/106, 403/107, 263
See application file for complete search history.

(56) References Cited

U.S. PATENT DOCUMENTS 2,833,421 A * 5/1958 Skubic ..... 211/194
3,847,489 A * 11/1974 Van Riper ..... 403/110
3,961,707 A 6/1976 Lehr
3,986,462 A * 10/1976 Heft ..... 108/188
4,128,064 A * 12/1978 Chung et al. ..... 108/192
4,527,490 A * 7/1985 Tipton et al. ..... 108/192
4,637,323 A * 1/1987 Nicely ..... 108/107
4,811,670 A * 3/1989 Kolvites et al. ..... 108/107
4,812,343 A 3/1989 Kiekhaefer
5,026,121 A 6/1991 Ratalahti
5,108,141 A * 4/1992 Anderson ..... 296/3
5,161,701 A * 11/1992 Berny ..... 211/193
5,174,200 A * 12/1992 Jeandel et al. ..... 108/187
5,183,167 A * 2/1993 Cheng ..... 211/187
5,271,337 A 12/1993 Kolvites
5,279,231 A 1/1994 Kolvites
5,285,613 A 2/1994 Goldsworthy
5,303,916 A 4/1994 Rodgers
5,423,251 A 6/1995 Kolvites
5,439,215 A 8/1995 Ratchford
5,647,650 A 7/1997 Daugherty
5,651,596 A 7/1997 Carlson
5,673,983 A 10/1997 Carlson
5,695,081 A * 12/1997 Alkalay ..... 211/187
(Continued)

*Primary Examiner* — Joshua J Michener
*Assistant Examiner* — Devin Barnett
(74) *Attorney, Agent, or Firm* — Marcus C. Dawes; Daniel L. Dawes

(57) ABSTRACT

A shelving system includes a plurality of vertical posts and horizontal traverses. The horizontal traverses are coupled to the vertical posts by means of a bifurcated collar that are placed on each vertical post. Each horizontal traverse includes an end piece which is configured to couple to both halves of the bifurcated collar. Each half of the bifurcated collar comprises a wedge shaped design such that when a load is placed on the traverse, forces are applied to the bifurcated collar that squeezes each half of the collar together more tightly around the vertical post. The traverses may be coupled to one or both sides of the vertical post to allow the shelving system to be extended as far as the user desires in any lateral direction. The shelving system may also be extended in a perpendicular or other angular direction by means of a wedge shaped corner connector.

6 Claims, 27 Drawing Sheets

U.S. PATENT DOCUMENTS 5,716,116 A 2/1998 Carlson
5,803,559 A 9/1998 Carlson
5,805,075 A 9/1998 Carlson
5,869,178 A 2/1999 Kusy
5,915,803 A 6/1999 Daugherty
5,922,195 A * 7/1999 Pastore ..... 210/154
6,029,833 A * 2/2000 Yeh ..... 211/189
6,044,988 A * 4/2000 Yang ..... 211/187
6,253,933 B1 * 7/2001 Yang ..... 211/187
6,290,073 B1 * 9/2001 Barnes et al. ..... 211/60.1
6,395,210 B1 5/2002 Head
6,431,090 B1 * 8/2002 Davis et al. ..... 108/107
6,561,366 B2 * 5/2003 Kim-So ..... 211/189
6,669,037 B1 * 12/2003 Ahn ..... 211/189
6,672,026 B2 1/2004 Sumerak
6,679,695 B2 1/2004 Kusy et al.
6,695,156 B1 * 2/2004 Wang ..... 211/187
6,834,768 B2 * 12/2004 Jersey et al. ..... 211/189
6,918,341 B1 7/2005 Welch et al.
6,939,257 B2 9/2005 Tiitola
7,086,633 B2 8/2006 Welch
7,100,781 B2 * 9/2006 Craft ..... 211/187
7,152,749 B2 * 12/2006 Beck ..... 211/194
7,267,310 B2 9/2007 Welch
7,293,667 B2 * 11/2007 Flynn ..... 211/189
7,568,436 B2 * 8/2009 McAllister et al. ..... 108/147.12
7,628,563 B2 * 12/2009 Winkler ..... 403/387
7,992,731 B2 * 8/2011 Mcallister et al. ..... 211/187
8,042,477 B2 * 10/2011 Lee ..... 108/147.12
2002/0113346 A1 * 8/2002 Constantinescu ..... 267/36.1
2003/0034320 A1 * 2/2003 Noh ..... 211/189
2003/0131767 A1 * 7/2003 Chen ..... 108/147.13
2004/0175563 A1 * 9/2004 Okerson ..... 428/331
2004/0253429 A1 * 12/2004 Polk et al. ..... 428/292.1
2005/0072071 A1 4/2005 Bonner, Jr.
2005/0155548 A1 7/2005 Shutic
2005/0163564 A1 7/2005 Tuell
2006/0163185 A1 * 7/2006 Konstant ..... 211/189
2007/0095775 A1 * 5/2007 Beck ..... 211/194
2007/0108147 A1 * 5/2007 Chen ..... 211/187
2007/0271869 A1 11/2007 Andrikanich
2008/0116156 A1 * 5/2008 Park ..... 211/59.2
2008/0127601 A1 6/2008 Schiffmann
2008/0172799 A1 * 7/2008 Constantinescu et al. ..... 5/740
2009/0099318 A1 * 4/2009 Miyamoto et al. ..... 525/421
2010/0089852 A1 * 4/2010 Wang ..... 211/153
2010/0108631 A1 * 5/2010 McAllister et al. ..... 211/187
2010/0155352 A1 * 6/2010 Hsieh ..... 211/134
2010/0181274 A1 * 7/2010 Vargo et al. ..... 211/187
2010/0319969 A1 * 12/2010 Vasoya et al. ..... 174/257

* cited by examiner

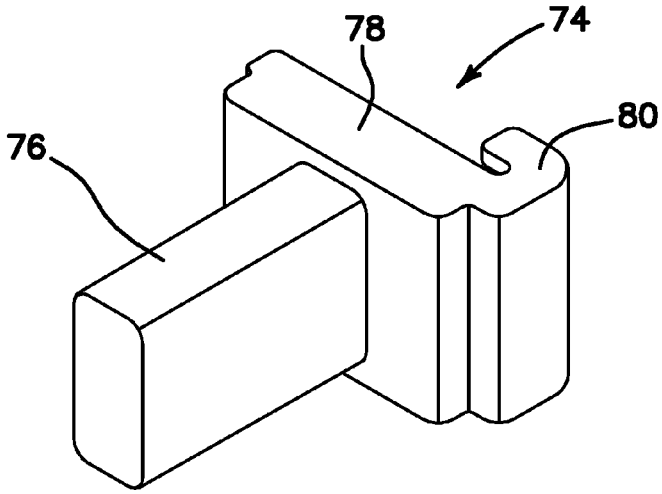
FIG. 11
FIG. 12
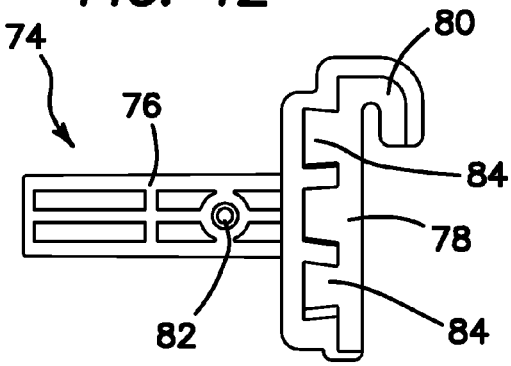
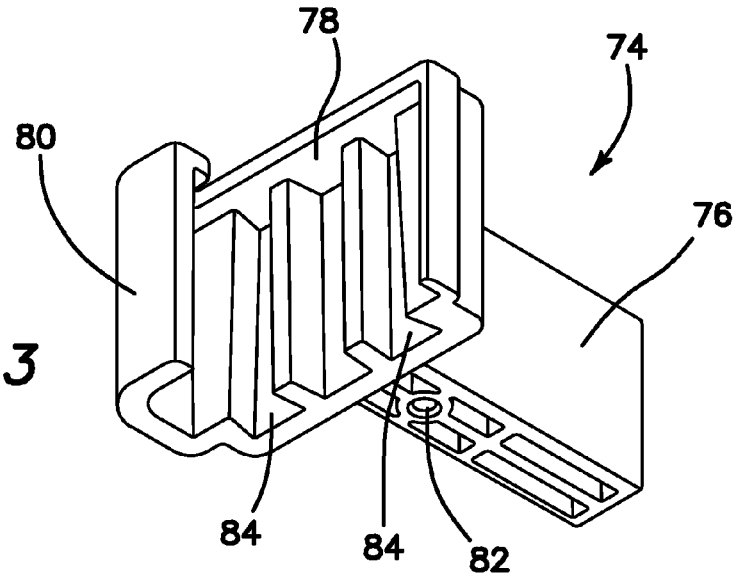
FIG. 13

SCALABLE SHELVING SYSTEM

BACKGROUND OF THE INVENTION

1. Field of the Invention

The invention relates to the field of shelving and shelving systems, particularly to shelving units fabricated by pultrusion or a continuous process of manufacturing of composite materials with a constant cross-section whereby reinforced fibers are pulled through a resin, possibly followed by a separate preforming system, and into a heated die, where the resin undergoes polymerization.

2. Description of the Prior Art

Utility or commercial shelving units or shelving systems comprised of different types of materials have long been used in art. Some of the materials commonly used include wood, metal, plastic or plastic composites. Many of these prior art shelving systems have a plurality of shelves which can either be fixed at certain predetermined heights or may be adjustable to one of a series of available heights be means of adjustable coupling means such as clamps, buckles, or sliding and locking mounts. Some shelving systems also include drawers or cabinets as well.

While many of the prior art designs are not without their respective merits, several limitations found in the prior art have become apparent. The first and most crucial of these limitations is the ratio of the load that may be supported by the shelving system to the weight of the shelving system itself. For example, a shelving system that is infused with concrete or reinforced steel may be able to support a relatively large load, however the weight that is added to the shelving system makes the entire system cumbersome and difficult to reconfigure or adjust to the specific needs of any specific user. On the other hand, if a shelving system is too light, the load it can support may be severely restricted thus limiting the scope of use of the shelving system.

Additionally, for shelving systems with shelves that may be adjusted to a user determined height, the means for coupling the shelves to their support posts can be overly complicated or inconvenient. Adjustable coupling means that are too complicated are more prone to malfunction and can add additional unnecessary weight to the shelving system. Inconvenient coupling means may similarly be difficult to use or require at least two people to operate.

What is needed is a shelving system that is strong enough to support large load distributions and yet still be light weight enough so that the shelves and shelving system as a whole are easy to adjust and reconfigure with a minimum number of steps required by the user.

BRIEF SUMMARY OF THE INVENTION

The current invention discloses a commercial or utility shelving system including a plurality of vertical posts disposed in the corner positions of a substantially rectangular shape, and a plurality of horizontal traverses disposed between the plurality of vertical posts. The traverses are coupled to the vertical posts in parallel pairs. The plurality of horizontal traverses are coupled to the plurality of vertical posts by means of a bifurcated collar that comprises two halves. The bifurcated collar includes two halves each of which have at least one substantially dove-tailed shaped male component. Each of the plurality of traverses also includes a traverse end piece coupled to each end. The traverse end piece includes two substantially dove-tailed female apertures defined which are sized and shaped to accommodate and capture the male component disposed or defined on or in each half of the bifurcated collar.

The shelving system further comprises a corresponding plurality of foot inserts coupled to the bottom of each of the plurality of vertical posts, wherein the foot inserts comprise means for raising and lowering the height of the vertical post it is coupled to.

In one embodiment, the plurality of traverse end pieces and bifurcated collars of the shelving system include means for distributing a load placed on the plurality of horizontal traverses, so that each half of each bifurcated collar is pushed toward each other and are squeezed around the vertical post it is coupled to. Each of the bifurcated collars are coupled to the corresponding plurality of vertical posts by means of inserting a tab disposed on each half of the bifurcated collar into a notch defined within the edge of the vertical post.

In another embodiment, the shelving system further includes at least two top post connectors and at least two bottom post connectors coupled between the plurality of vertical posts at an orientation perpendicular to that of the plurality of horizontal traverses. The two top post connectors and two bottom post connectors each comprise a cap disposed at either end, each cap itself including an aperture sized to accommodate and capture the cross section of the vertical posts it is coupled to, along with at least two wedge components also coupled to the vertical post. The two wedge components are sized and shaped for directing a downward force placed on the at least two top post connectors or on the at least two bottom post connectors towards the center of the plurality of vertical posts.

The invention also provides for a shelving system including a primary module which includes at least four vertical primary posts disposed in the corner positions of a substantially rectangular shape. The primary module also includes at least one pair of parallel horizontal primary traverses coupled at either end to the primary posts, at least one shelf plate disposed on top of the at least two primary traverses, and at least one secondary module coupled to the primary module. The secondary module includes at least two vertical posts, at least one pair of parallel horizontal traverses coupled at one end to the at least two vertical posts of the secondary module and coupled at the opposing end to the primary module, and at least one shelf plate disposed over the at least one pair of parallel traverses of the secondary module.

In one embodiment the secondary module coupled to the primary module of the shelving system is coupled along the same longitudinal axis as the primary module. The pair of parallel traverses of the secondary module is coupled to at least two of the four vertical primary posts of the primary module. The pair of parallel traverses of the secondary module coupled to two of the four vertical primary posts of the primary module of the shelving system are coupled by means including a traverse end piece coupled to the end of each of the pair of parallel traverses of the secondary module and a bifurcated collar removeably coupled to the two of the four vertical primary posts. Each traverse end piece includes a pair of female apertures. The bifurcated collar includes two halves with at least one male component disposed on each half.

In yet another embodiment, the shelving system includes a plurality of secondary modules which are coupled together in series to the primary module along the same longitudinal axis as the primary module. In this embodiment, each of the plurality of secondary modules includes at least one top post connector and at least one bottom post connector sized to accommodate and capture the cross section of the vertical posts it is coupled to along with a plurality of wedge components also coupled to the vertical post.

In another embodiment, the secondary module coupled to the primary module of the shelving system is coupled perpendicularly to the longitudinal axis of the primary module. In this embodiment, the pair of parallel traverses of the secondary module is coupled to at least one of the horizontal primary traverses of the primary module. The pair of parallel traverses of the secondary module coupled to one of the horizontal primary traverses of the primary module are coupled by means including a traverse end piece coupled to the end of each of the pair of parallel traverses of the secondary module and t least two corner connectors removeably coupled to one of the horizontal primary traverses. Each traverse end piece includes a pair of female apertures. Each corner connector includes at least two male components disposed on an outward facing surface of the corner connector.

In yet another embodiment, the shelving system comprises a plurality of secondary modules being coupled together in series to the primary module perpendicularly to the longitudinal axis of the primary module. Each of the plurality of secondary modules include at least one top post connector and at least one bottom post connector sized to accommodate and capture the cross section of the vertical posts it is coupled to along with a plurality of wedge components also coupled to the vertical post.

In a further embodiment, the shelving system further includes a plurality of secondary modules coupled to the primary module in a linked series. The angular orientation of the coupling of the secondary modules to each other may be different or the same as the angular orientation of the secondary module first connected directly to the primary module. For example, the modules may be coupled to each other to form a linear series of any type of angulated series desired according to the means for inter-module coupling provided between them.

Finally, the invention provides for a method of coupling a first horizontal traverse to a vertical post or to a second horizontal traverse within a shelving system including the steps of placing a coupling means onto the vertical post or the second horizontal traverse, sliding a traverse end piece coupled to the end of the first horizontal traverse downward over the coupling means placed on the vertical post or the second horizontal traverse, and capturing the coupling means in the traverse end piece.

In one embodiment, the step of placing a coupling means onto the vertical post or the second horizontal traverse includes inserting two halves of a bifurcated collar into a corresponding pair of notches defined within the vertical post. In this embodiment, the method further includes inserting a male component disposed on each half of the bifurcated collar into a corresponding pair of female apertures defined in the traverse end piece, and sliding the female apertures of the traverse end piece downward about the male components of the bifurcated collar until both male components are completely enveloped by the female apertures.

In a separate embodiment, the step of placing a coupling means onto the vertical post or the second horizontal traverse includes coupling a corner connector to the second horizontal traverse. In this embodiment, the step further includes inserting a pair of male components disposed on an outward surface of the corner connector into a corresponding pair of female apertures defined in the traverse end piece, and sliding the female apertures of the traverse end piece downward about the male components of the corner connector until both male components are completely enveloped by the female apertures.

In another embodiment the invention is illustrated as a shelving system which includes a plurality of vertical posts and horizontal traverses fabricated by the pultrusion process. The horizontal traverses are coupled to the vertical posts by means of a bifurcated collar that are placed on each vertical post. Each horizontal traverse comprises an end piece which is configured to couple to each half of the bifurcated collar. Each half of the bifurcated collar includes a wedge shaped design such that when a load is placed on the traverse, forces are applied to the collar that squeezes each half of the collar together more tightly around the vertical post. The traverses may be coupled to one or both sides of the vertical post allowing the shelving system to be extended as the user may desire in the lateral direction. The shelving system may also be extended in the perpendicular direction by means of a wedge shaped corner connector.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

BRIEF DESCRIPTION OF THE DRAWINGS

FIG. 11 is a top perspective view of the traverse end piece of the shelving system.

FIG. 12 is a bottom plan view of the traverse end piece shown in FIG. 11.

FIG. 13 is a bottom perspective view of the traverse end piece shown in FIG. 11.

FIG. 22 is a perspective view of the bottom post connector and its orientation to that of the vertical post in which it is coupled to.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described below.

DETAILED DESCRIPTION OF THE PREFERRED EMBODIMENTS

Figure 1:
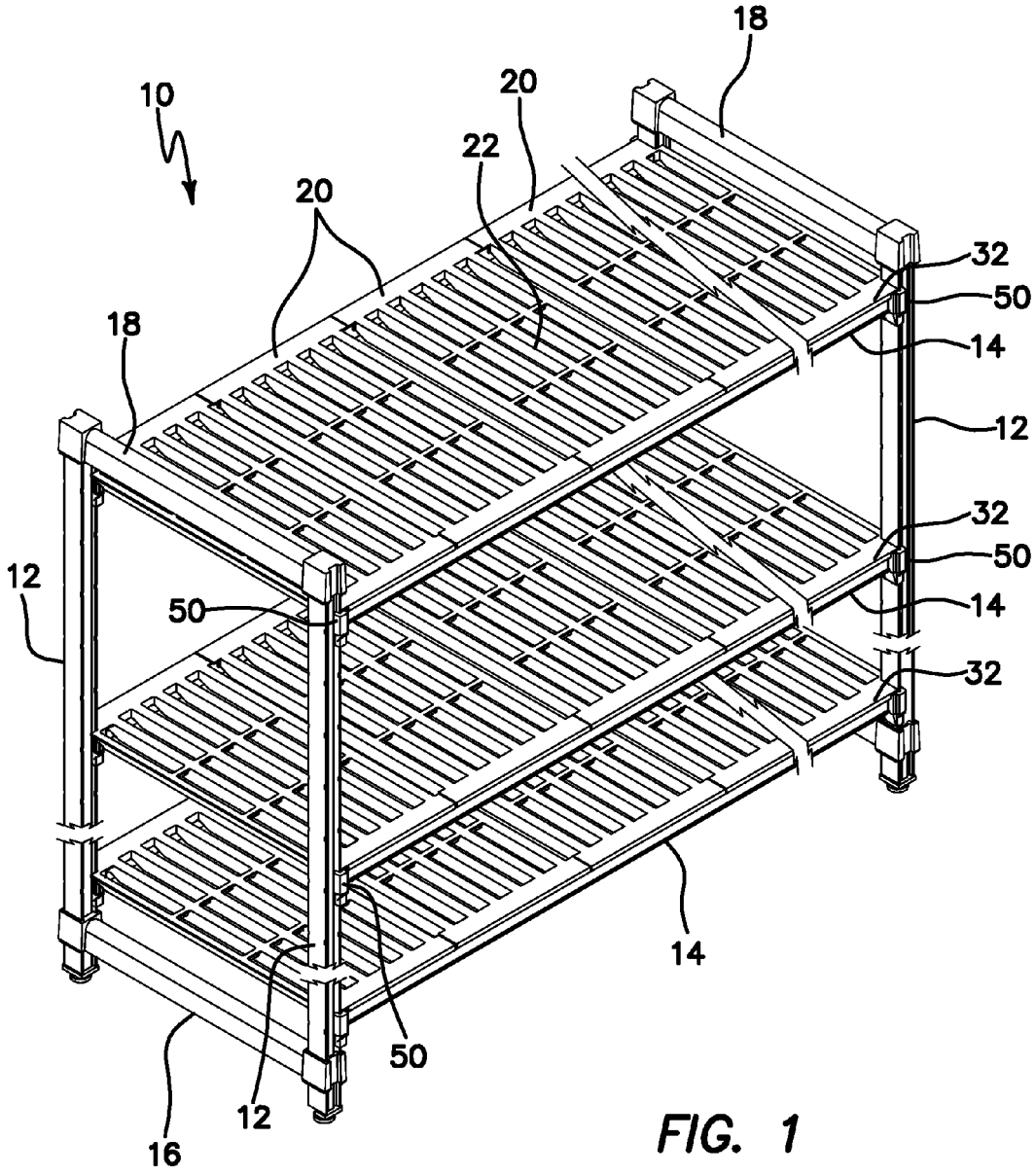
FIG. 1 is a perspective view of the main embodiment of the shelving system.

A first embodiment of the current invention is seen in FIG. 1 where the shelving system is generally denoted by reference numeral 10. The shelving system primarily comprises a plurality of primary vertical posts 12 arranged in a substantially rectangular pattern. One primary vertical post 12 is disposed at each respective corner of the rectangle. While there are four primary vertical posts 12 shown in FIG. 1, it is important to note that any number of vertical posts may be used in any number of shapes such as squares, circles, semi-circles and the like without departing from the original spirit and scope of the invention.

Disposed laterally between the plurality of primary vertical posts 12 are a plurality of primary horizontal traverses 14. In the embodiment shown in FIG. 1, the primary horizontal traverses 14 are paired up in parallel groups of two and are coupled to primary vertical posts 12 at either end of each primary traverse 14. Each pair of primary traverses 14 thereby forms the support structure of a shelf 22. Again, fewer or additional shelves 22 that what is shown in FIG. 1 may be used without departing from the original spirit and scope of the invention. Disposed across each pair of primary traverses 14 is a plurality of shelf plates 20. The shelf plates rest across the primary traverses 14 and are held in place by gravity. The shelf plates 20 are removable and may be placed along the entire lateral length of the primary traverses 14 as is shown in FIG. 1, or alternatively they may be placed at any position along the primary traverse 14 according the specific selection of a user.

Disposed perpendicularly between the primary vertical posts 12 on either end of the shelving system 10 and near the lower ends of the posts 12 is a bottom post connector 16. Similarly, disposed perpendicularly between the primary vertical posts 12 on either end of the shelving system 10 and near the upper ends of the posts 12 is a top post connector 18.

Figure 2:
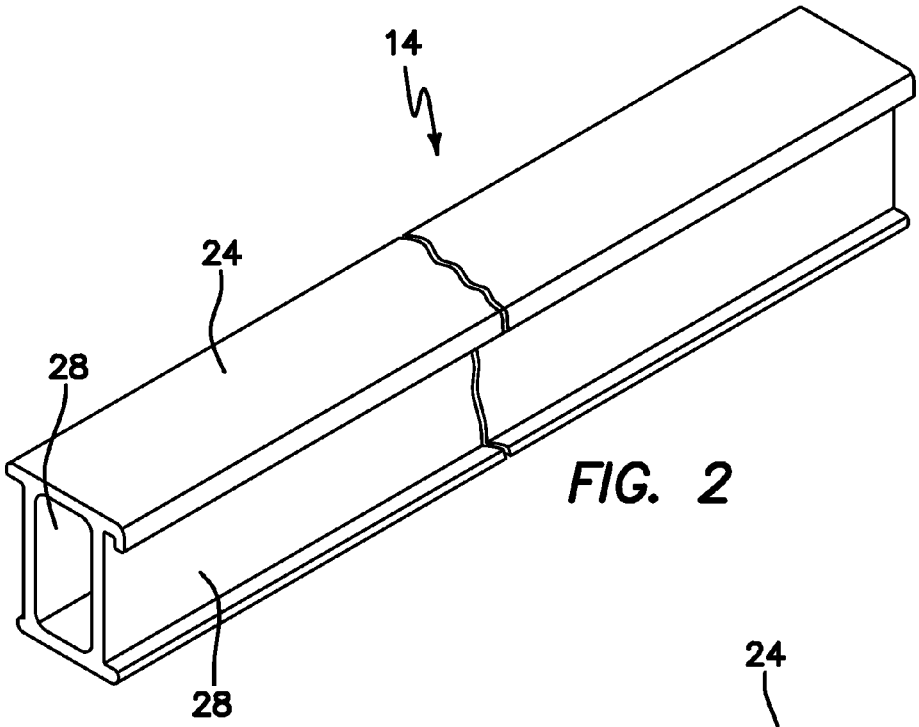
FIG. 2 is a truncated perspective view of a horizontal traverse of the shelving system.
Figure 4:
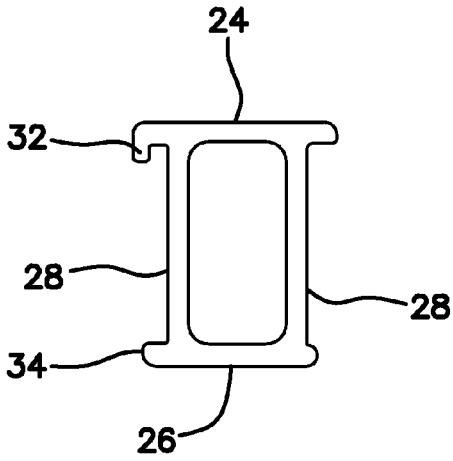
FIG. 4 is a cross-sectional view of the horizontal traverse taken from the opposing end of the traverse from that of FIG. 3.
Figure 3:
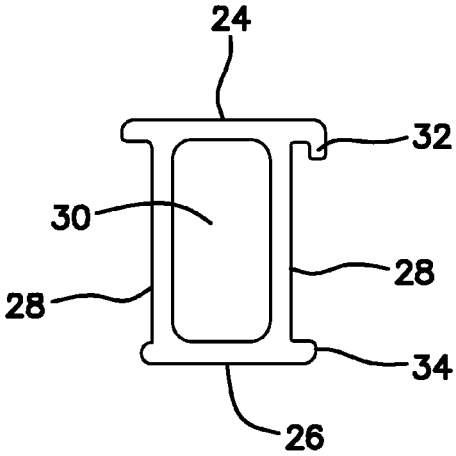
FIG. 3 is a cross-sectional view of the horizontal traverse seen in FIG. 2.

A better understanding of the primary horizontal traverses 14 can be had by turning to FIGS. 2-4. Each primary traverse 14 is substantially shaped in a hollow, prismatic, double I-beam configuration as seen in the cross sections of FIGS. 3 and 4. The double I-beam configuration comprises a top surface 24, a bottom surface 26 as indicated in FIG. 3, and two side walls 28 with a hollow cavity 30 defined there between and throughout the length of the traverse 14. Each traverse 14 also comprises a downturned lip 32 adjacent to the top surface 24 and an extended segment 34 adjacent to the bottom surface 26 throughout its length. Preferably, the lip 32 faces "outward" or to the "outside" of the shelving system 10, namely on the opposite side of the traverse 14 that comes into contact with the shelf plates 20. For example, for each pair of primary traverses 14, there is a "right" traverse 14 and a corresponding "left" traverse 14. For the "right" traverses 14 visible in FIG. 1, the lip 32 and extended segment 34 are facing to the right of the traverse 14 as seen in the cross sectional view of FIG. 3. Similarly, for the "left" traverses not visible in FIG. 1, the lip 32 and extended segment 34 face to the left of the traverse 14 as seen in the cross sectional view of FIG. 4. A "left" traverse 14 is simply a "right" traverse 14 which has been rotated 180 degrees around an axis perpendicular to face 24.

Figure 5A:
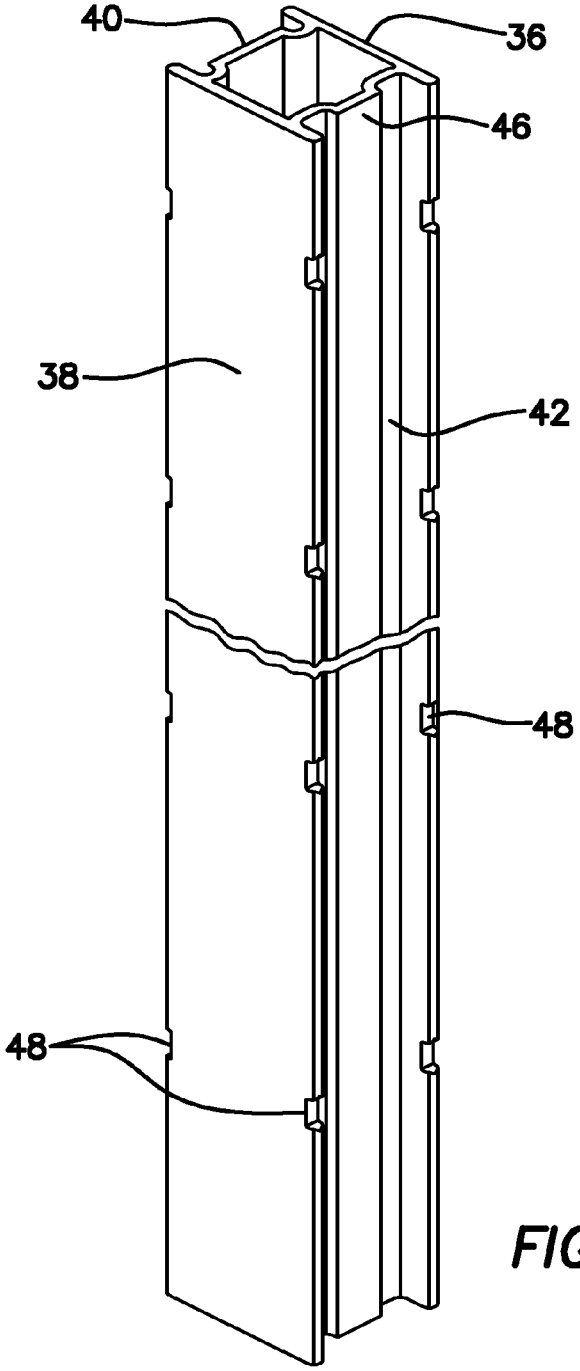
FIG. 5A is a truncated perspective view of a vertical post of the shelving system.
Figure 5B:
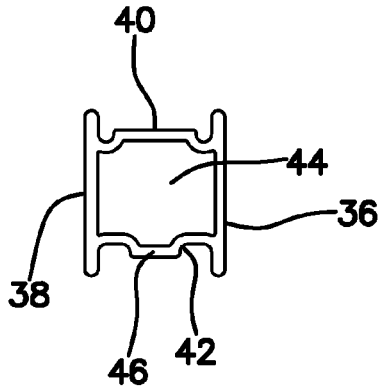
FIG. 5B is a cross-sectional view of the vertical post seen in FIG. 5A.
Figure 5C:
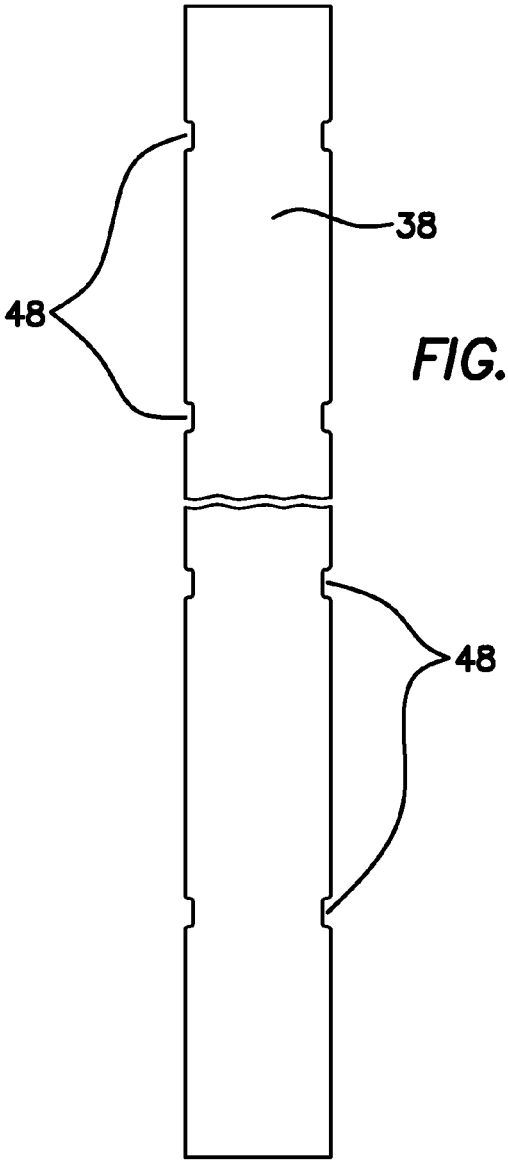
FIG. 5C is a truncated side view of the vertical post seen in FIG. 5A.

A better understanding of the primary vertical posts 12 can be had by turning now to FIGS. 5A-5C. Each primary vertical post 12 is substantially shaped in a hollow, prismatic, double I-beam configuration as seen in the cross section of FIGS. 5B. The double I-beam configuration of the primary posts 12 comprise an inner surface 36, an outer surface 38, a straight surface 40, a ridged surface 42, and a hollow cavity 44 defined there between. The straight surface 40 is substantially flat between the inner surface 36 and outer surface 38, including possibly longitudinal grooves 40*a*, while the ridged surface 42 comprises a central ridge 46 along the longitudinal length of the primary posts 12. Preferably, the ridged surface 42, like the lip 32 of the primary traverses 14, faces outwardly from the shelving system 10. Also defined in the lateral edges of the inner surface 36 and outer surface 38 are a plurality of square shaped notches 48 best seen in FIGS. 5A and 5C. The notches 48 are uniformly defined along the edges of the inner and outer surfaces 36, 38 at regularly spaced intervals along the longitudinal length of the primary posts 12 as seen in FIGS. 5A and 5C, however it is to be expressly understood that fewer or additional notches 48 defined at differing intervals along the posts 12 then what are shown may be used without departing from the original spirit and scope of the invention.

Before discussing the structure of the shelving system 10 further, turn first to consider the process of pultrusion by which certain ones of the elements of the system 10 are made. Both the primary horizontal traverses 14 and the primary vertical posts 12 are comprised of plastic or plastic composites and are fabricated by the known process of pultrusion. Briefly, the process of pultrusion includes a plurality of strands of fiberglass or other suitable material being extruded from a plurality of rovings disposed on a rack. The strands are brought together with other materials such as mats and are placed in a resin bath or are otherwise impregnated with resin and other substances that bind the roving strands together. The resin infused strands are then mechanically pulled through a forming die which forms the fiberglass to a predetermined shape. After being pulled, heated, or cured, a saw cuts the pultruded component down to a desired length or a plurality of lengths.

Returning now to consideration of the structure of system 10, turn to FIGS. 6-9 and 11-13. The primary horizontal traverses 14 are coupled to the primary vertical posts 12 by means of a plurality of removable bifurcated collars 50, shown in greater detail in FIGS. 6-9, and a corresponding plurality of traverse end pieces 74, shown in greater detail in FIGS. 11-13.

Figure 6:
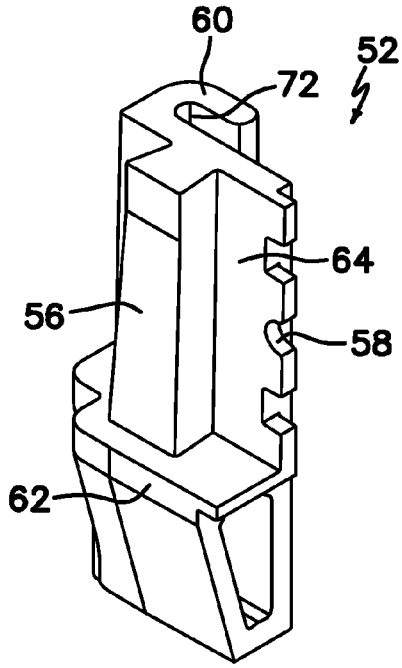
FIG. 6 is a perspective view of the left half of the bifurcated collar of the shelving system.
Figure 7A:
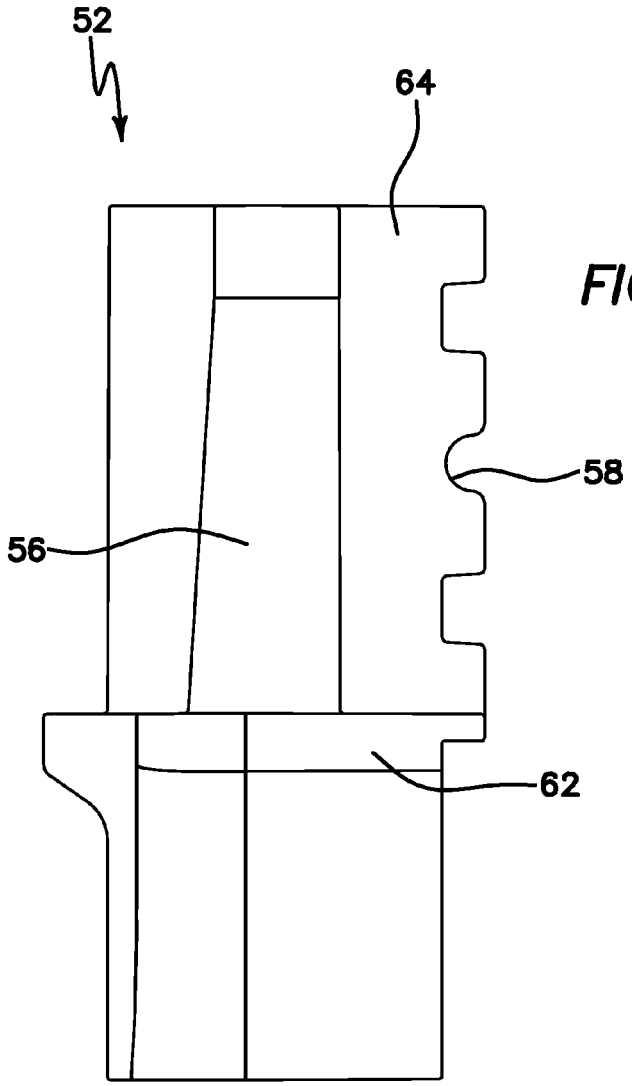
FIG. 7A is a frontal plan view of the left half of bifurcated collar seen in FIG. 6.
Figure 7B:
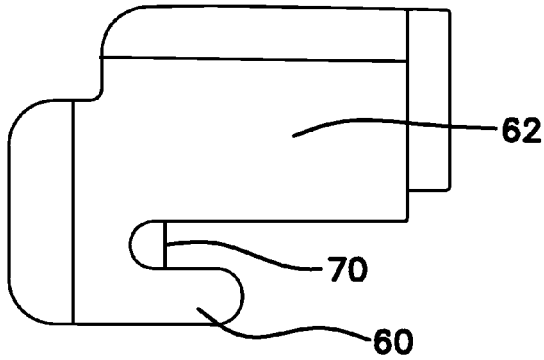
FIG. 7B is a bottom plan view of the left half of the bifurcated collar seen in FIG. 6.
Figure 8:
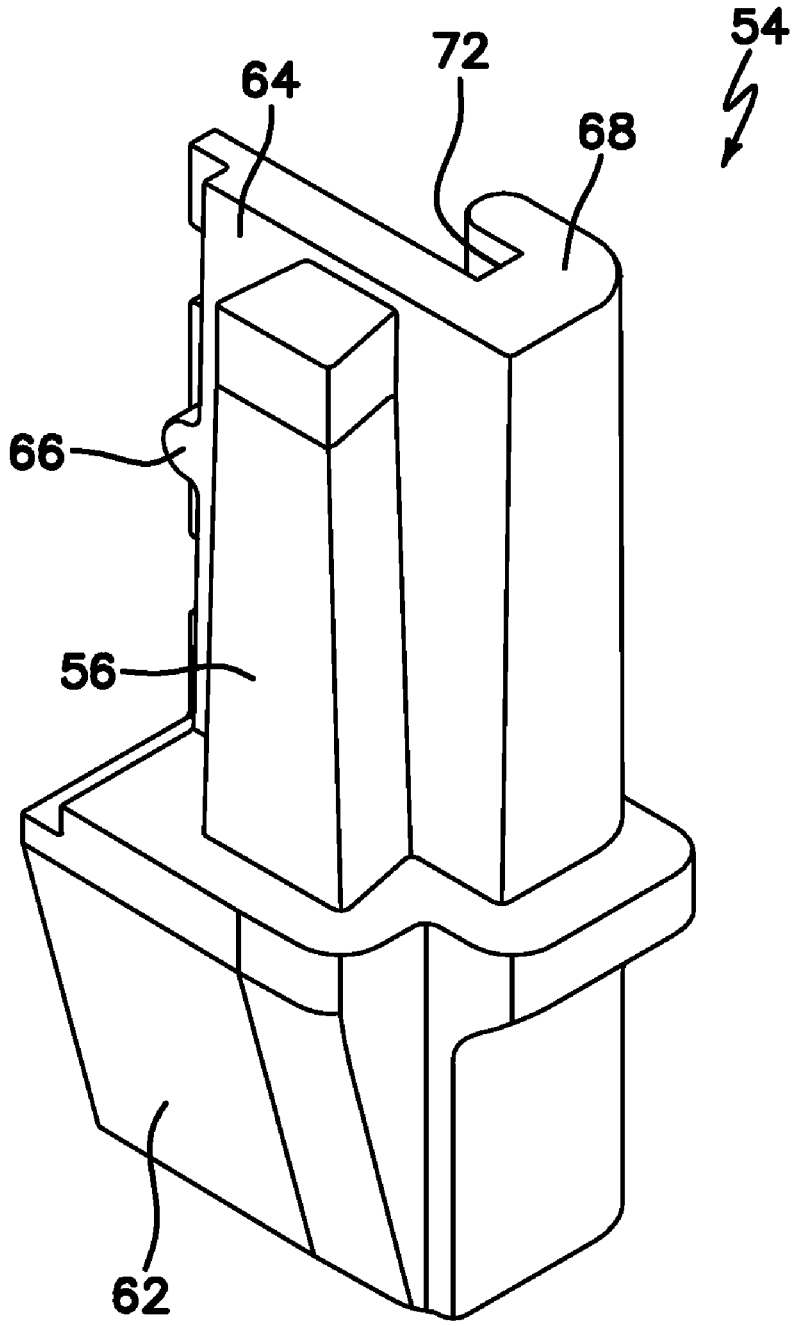
FIG. 8 is a perspective view of the right half of the bifurcated collar of the shelving system.
Figure 9A:
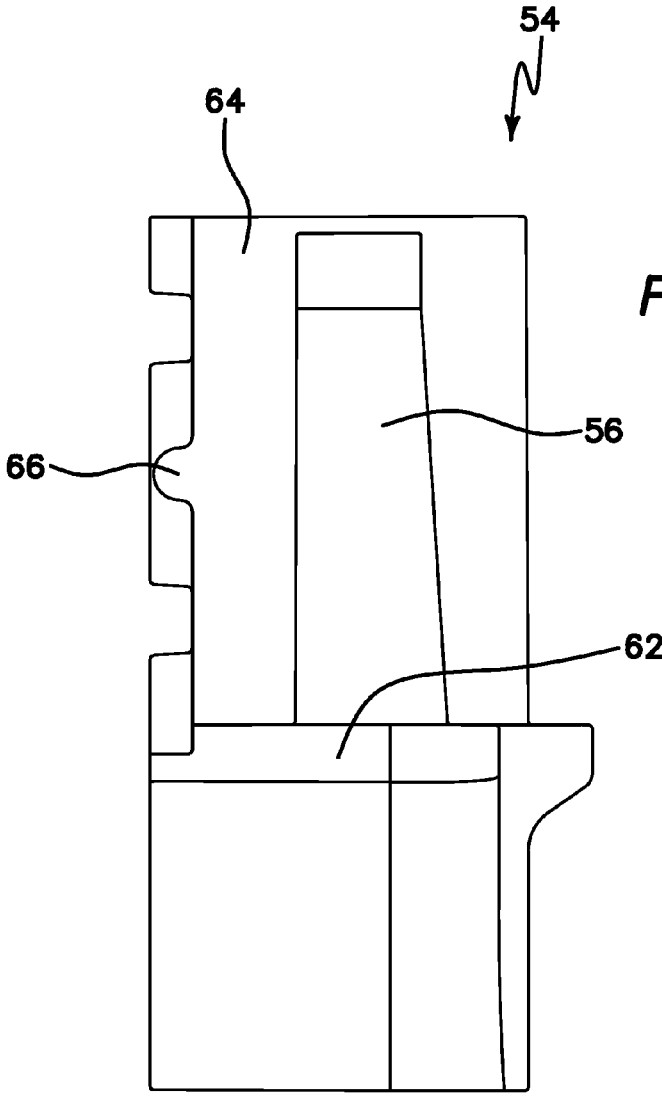
FIG. 9A is a frontal plan view of the right half of bifurcated collar seen in FIG. 8.
Figure 9B:
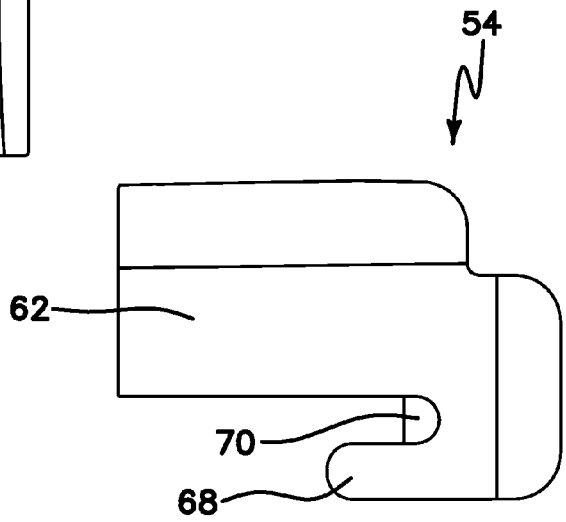
FIG. 9B is a bottom plan view of the right half of the bifurcated collar seen in FIG. 8.

The bifurcated collar 50 comprises a left half 52 shown in FIGS. 6-7B, and a right half 54 shown in FIGS. 8-9B. Each left and right half 52, 54 comprises a base 62 and a post connector portion 64. Each left and right half 52, 54 also comprises a male component 56 that is disposed on the base 62 and adjacent to the post connector 64. Each male component 56 is substantially dove-tailed shaped, that is to say, the male component 56 is wider at that bottom near the base 62 than at the top.

Turning now to the left half 52 of the bifurcated collar 50 in FIGS. 6-7B, it can be seen that the left half 52 comprises a female notch 58 that is substantially semi-circular in shape along the right edge of the post connector portion 64 as seen in the depiction of FIG. 6. The left edge of the post connector portion 64 bends around on itself behind to form a left hook 60 and to define a groove 72. The left hook 60 and groove 72 are disposed on the backside of the left half 52 throughout its entire longitudinal length. Disposed in the groove 72 between the left hook 60 and the post connector portion 64 is a substantially square shaped tab 70 as best seen in FIG. 7B. The tab 70 is substantially rectangle shaped and is disposed only in the top portion of the groove 72 near the top of the post connector portion 64 although not visible in the perspective view of FIG. 6.

Turning now to the right half 54 of the bifurcated collar 50 in FIGS. 8-9B, it can be seen that the right half 54 comprises a male tooth 66 that is substantially semi-circular in shape along the left edge of the post connector portion 64. The right edge of the post connector portion 64 as seen in the depiction of FIG. 8 bends around on itself to form a right hook 68 and groove 72. The right hook 68 and groove 72 are disposed on the backside of the right half 54 throughout its entire longitudinal length. Disposed in the groove 72 between the right hook 68 and the post connector portion 64 is a substantially square shaped tab 70 as best seen in FIG. 9B. The tab 70 is substantially rectangle shaped and is disposed only in the top portion of the groove 72 near the top of the post connector portion 64 although not visible in the perspective view of FIG. 8.

Turning to FIG. 11, each of the plurality of traverse end pieces 74 comprises a body portion 76 and a head portion 78. Each of the plurality of traverse end pieces 74 are coupled to either end of the primary traverses 14 by first inserting the body potion 76 into the hollow cavity 30 of the primary traverse 14. Next, a screw (not shown) is then inserted into a screw aperture 82 located on the bottom of the body portion 76 as seen in FIGS. 12 and 13, locking the traverse end piece 74 into place. In addition to screws, other coupling means such as bolts, pins, glues or clamps can be used without departing from the original spirit and scope of the invention.

The head portion 78 of the traverse end piece 74 further comprises a curved edge 80 that wraps around one of the lateral edges of the head portion 78. Which lateral edge of the head portion 78 comprises the curved edge 80 depends upon which end of the primary traverse 14 the traverse end piece 74 is to be coupled. However the curved edge 80 is always on the "outside" of the shelving system 10. For example, for the traverse end piece 74 shown in FIGS. 14A and 14B, the curved edge 80 is on the right lateral side of the head portion 78, or in other words, on the "outside" of the shelving system 10 away from the shelf plates 20. It should be understood therefore that the traverse end piece 74 on the opposite end of the primary traverse 14 shown in FIG. 14A would have its curved edge 80 on the left lateral side of the head portion 78. The same configuration applies to all the traverse end pieces 74 within each primary traverse 14 for as many shelves 22 as there are in the shelving system 10.

Each head portion 78 also comprises at least two female apertures 84 defined within its distal face as best seen in FIGS. 12 and 13. Each of the female apertures 84 are substantially dove-tailed shaped in both length and depth. For example, in FIG. 12 it can be seen that each female aperture 84 is dove tailed shaped in depth, namely that they widen in size the further they are defined within the head portion 78. Additionally, as can be seen in FIG. 13 each female aperture 84 is dove tailed shaped in length, namely that they start at a certain width at the top of the head portion 78 and then widen in size the more they are vertically defined within the head portion 78 toward the bottom of head portion 78.

Figure 10B:
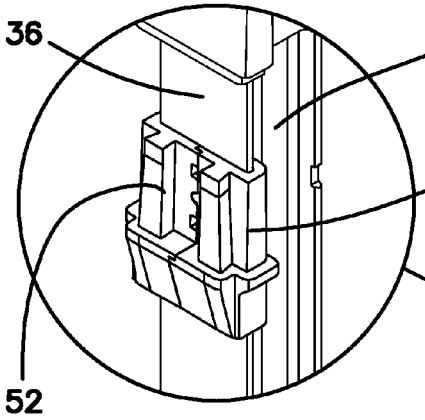
FIG. 10B is a magnified view of the coupling between the bifurcated collar and the vertical post highlighted in FIG. 10A.
Figure 10A:
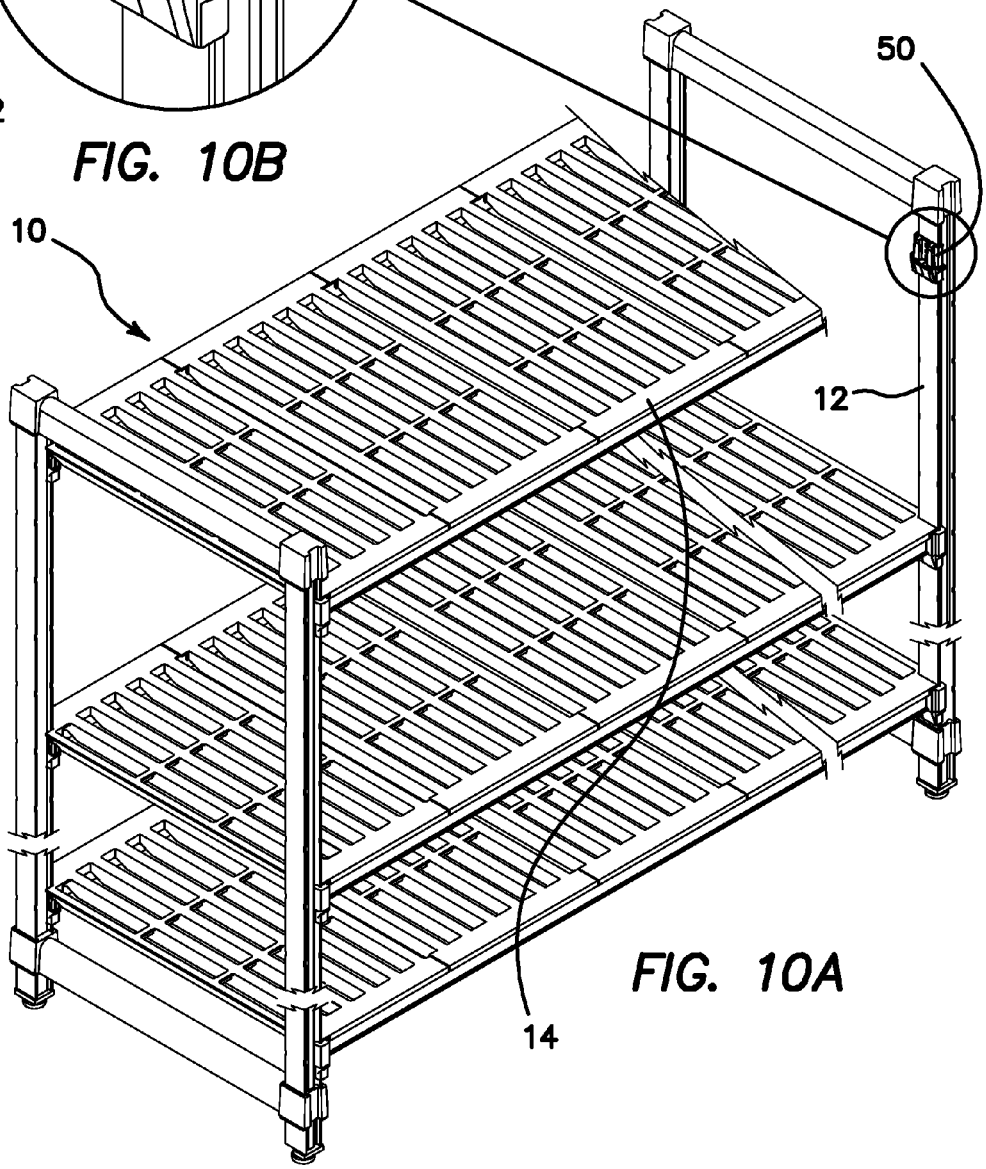
FIG. 10A is a truncated perspective view of the shelving system depicting the bifurcated collar coupled to one of the plurality of vertical posts.

As illustrated in the magnified view of inset FIG. 10B in order to couple a primary traverse 14 to a primary post 12, a user first takes the left half 52 and right half 54 of a bifurcated collar 50 and places each half 52, 54 around the opposing vertical edges of the inner surface 36 or the outer surface 38 of the post 12 according to which side of post 12 attachment is sought, so that each corresponding left hook 60 and right hook 68 of the halves 52, 54 securely engage the edges of the post 12. The user then may slide each half 52, 54 of the bifurcated collar 50 up or down the primary post 12 to a pair of notches 48 that correspond to the height at which the user wishes to locate the shelf 22. As the bifurcated collar 50 is being moved to the desired pair of notches 48, the tabs 70 disposed within the grooves 72 of each of the halves 52, 54 can be slid into the notches 48. At this point the male tooth 66 disposed on the right half 54 also slides into the female notch 58 defined on the left half 52, thus ensuring the two halves 52, 54 of the bifurcated collar 50 are properly aligned during the coupling process. Due to the substantially square shape of both the notch 48 and tab 70, once the tab 70 is within the notch 48, any further vertical movement along the posts 12 is prevented. With the bifurcated collar 50 firmly in place at its desired position as seen in FIGS. 10A and 10B, a traverse 14 with a traverse end piece 74 coupled into its end is then slid onto the bifurcated collar 50 by first sliding the female apertures 84 of the head portion 78 of traverse end piece 74 as shown in FIG. 12 down onto the male components 56 disposed on each left and right half 52, 54 of the bifurcated collar 50. As the female apertures 84 are being slid down over the male components 56, the curved portion 80 of the traverse end piece 74 as shown in FIG. 11 also slides down around the bifurcated collar 50, namely the right hook 68 of the right half 54 as seen in FIG. 14A and the magnified view of the insert of 14B.

Figure 31:
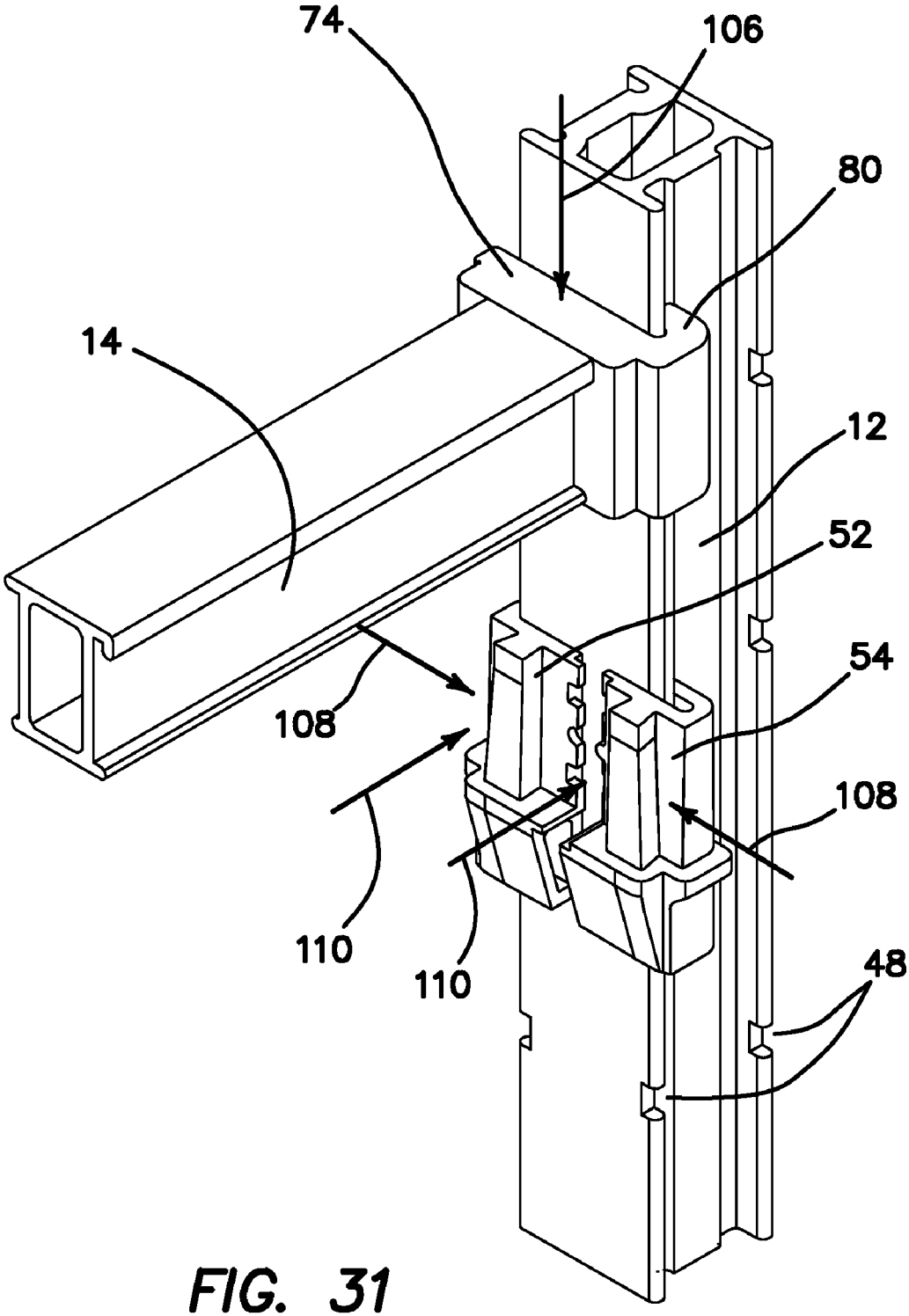
FIG. 31 is a partially exploded view of the coupling between the traverse end piece and bifurcated collar and includes the orientations of the forces distributed by the bifurcated collar when a load is placed on the traverse end piece.

It is important to point out that due the substantially dove-tailed shape of both the female apertures 84 of the traverse end piece 74 and the male components 56 of the collar halves 52, 54, the further the female apertures 84 are slid downward about the male components 56, the more force that is created and directed toward the center of the primary post 12 from each respective half 52, 54 as illustrated by the vectors 110 depicted in FIG. 31. As the force or load represented by vector 106 is placed on the traverse 14, the two halves 52, 54 are more tightly squeezed together by the pair of forces represented by vectors 108 about the inner or outer surface 36, 38 of the primary post 12 to which halves 52, 54 are coupled. Additionally, because the female apertures 84 and male components 56 are dove-tailed in both their length and width, another pair of forces represented by vectors 110, push each of the collar halves 52, 54 against the primary post 12.

Figure 32:
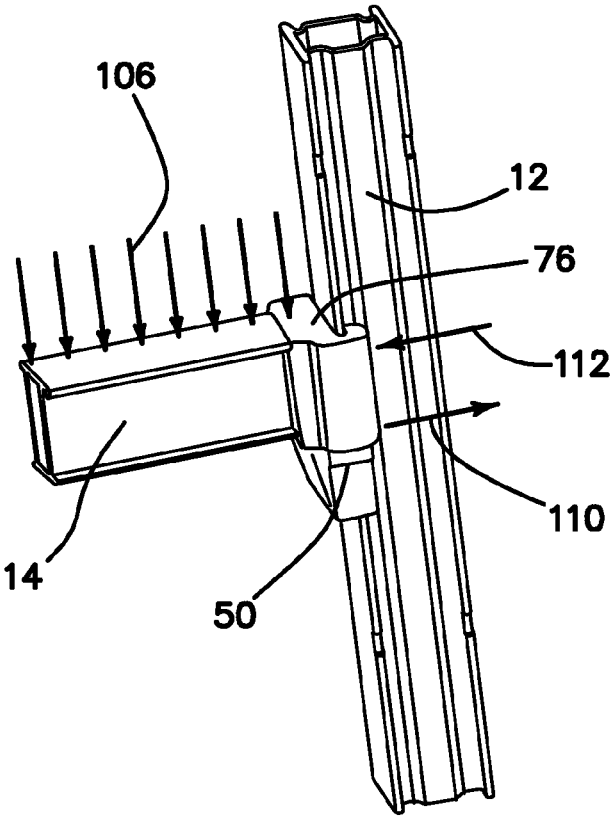
FIG. 32 is a side view of the horizontal traverse when coupled to a vertical post and the orientation of forces distributed by the bifurcated collar into the vertical post when a load is placed on the horizontal traverse.

Both the squeezing force 108 and inward force 110 thus create a corresponding and equal set of reactive forces that keeps the bifurcated collar 50, traverse 14, and post 12 in a locked and stable position. For example, as seen in FIG. 32, when the loading vector 106 is placed on the traverse 14, the inward force vector 110 described above corresponding to that of the load vector 106, pushes the bifurcated collar 50 against the post 12. The post 12 in turn responds with a reactive force vector 112 that pushes the collar 50 in the opposite direction to that of the inward force vector 110 created by the load vector 106, thus maintaining static equilibrium between the traverse 14 and post 12. It is because of the dove-tailed shaped components which allows for the force distribution scheme described above and the strength of the traverses 14 and posts 12 fabricated by pultrusion that allows for large amounts of load to be placed on the traverses 14 and thus by extension, on the shelving system 10.

Figures 14A, 14B:
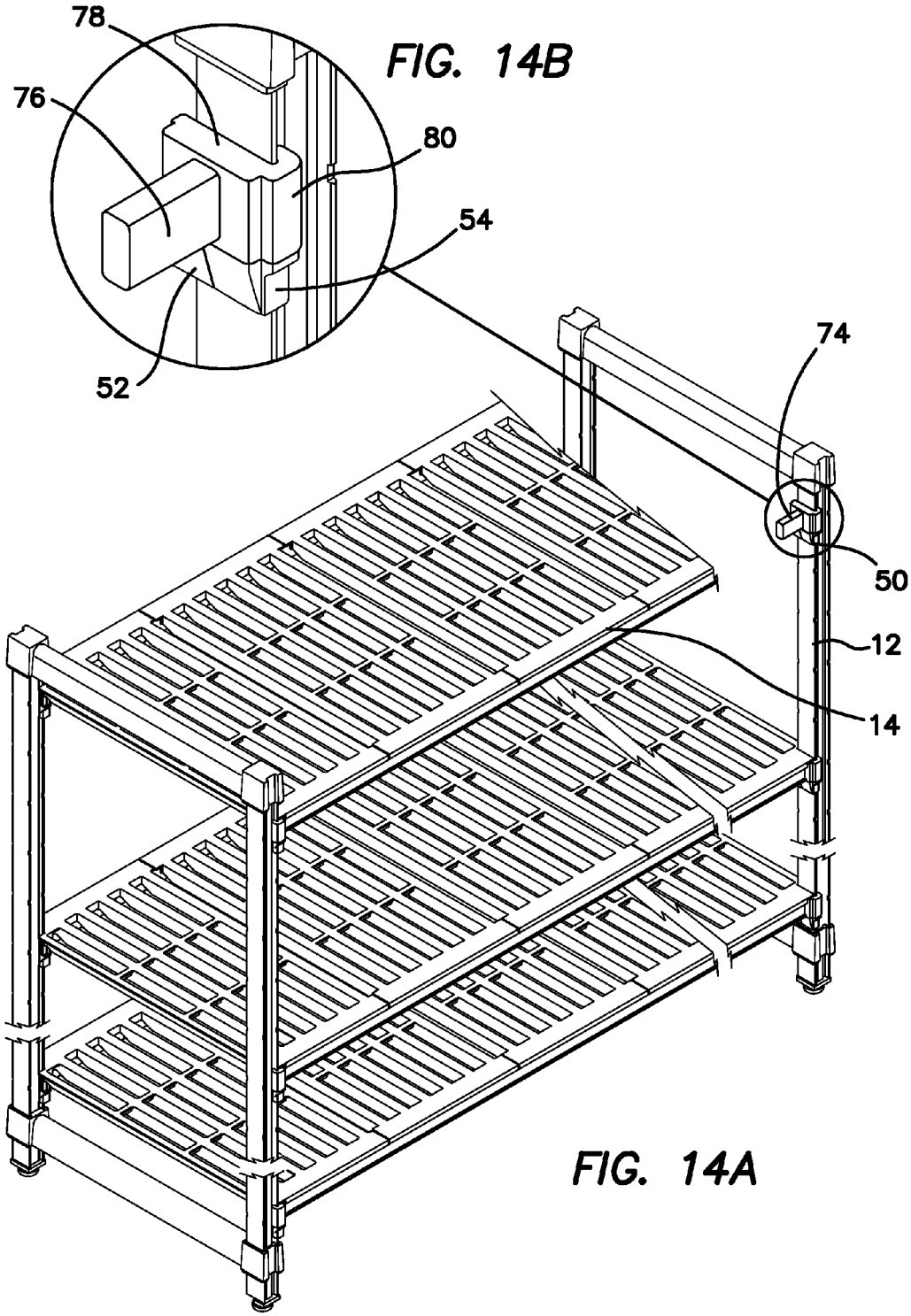
FIG. 14A is a truncated perspective view of the shelving system depicting the traverse end piece coupled to the bifurcated collar.
FIG. 14B is a magnified view of the coupling between the traverse end piece and bifurcated collar highlighted in FIG. 14A.
Figure 15:
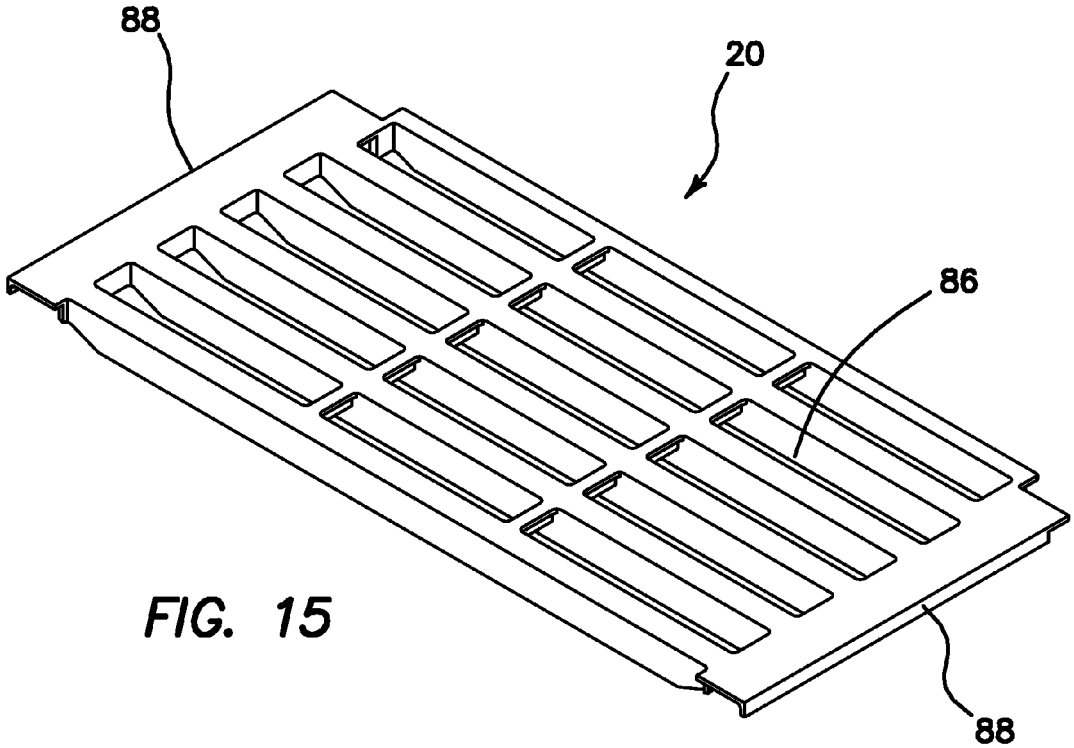
FIG. 15 is a perspective view of a shelf plate of the shelving system.
Figure 16:
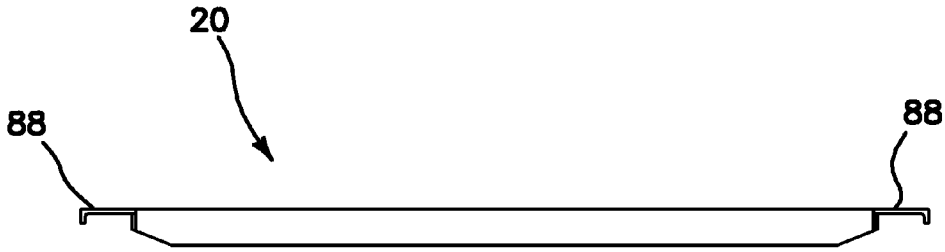
FIG. 16 is a side plan view of the shelf plate shown in FIG. 15.

Once the head portion 78 of the traverse end piece 74 is fully slid down about the male components 56 to the base 62 of the bifurcated collar 50 as seen in FIGS. 14A and 14B, a maximum force is created that squeezes the collar 50 tightly onto the primary post 12 and thus eliminating any need for any further coupling means. The same coupling process described above is then repeated for the opposing end of traverse 14 thus leaving the traverse 14 firmly in place laterally between two primary posts 12 on either side of the shelving system 10 as seen in FIG. 1.

To remove or decouple the traverse 14 from the post 12, the user pushes up on the traverse 14 and the traverse end piece 74. In doing so, the head portion 78 of the traverse end piece 74 moves vertically up the collar 50. The female apertures 84 slide vertically up the male components 56, decreasing the amount squeezing force applied to the primary post 12 by the bifurcated collar 50 along the way. Once the female apertures 84 are clear of the male components 56, the user is then free to remove one or both of the halves 52, 54 from the primary post 12 and insert them into a new pair of notches 48 and repeat the process describe above to relocate the traverse 14 at a new position if desired.

Figure 20:
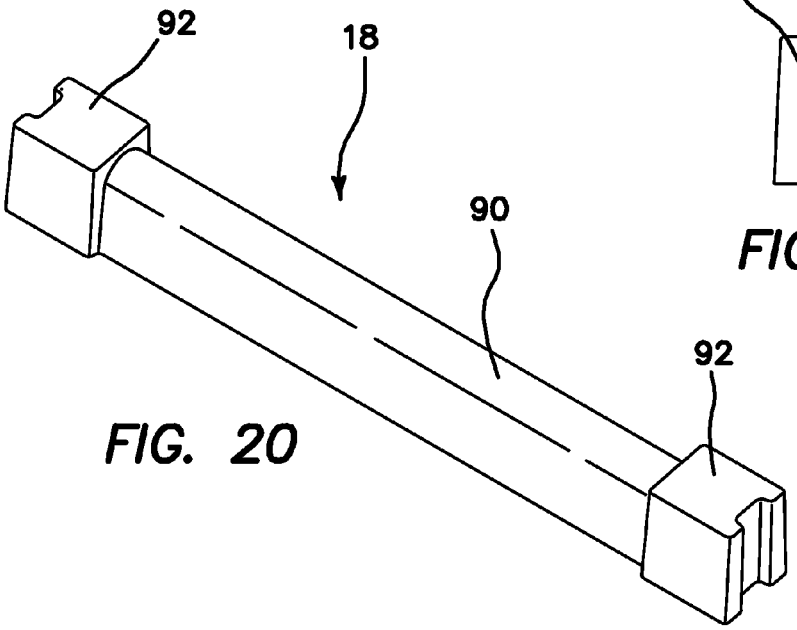
FIG. 20 is a perspective view of the top post connector of the shelving system.
Figure 21:
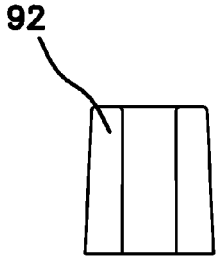
FIG. 21 is a side plan view of the top post connector of the shelving system.
Figure 23:
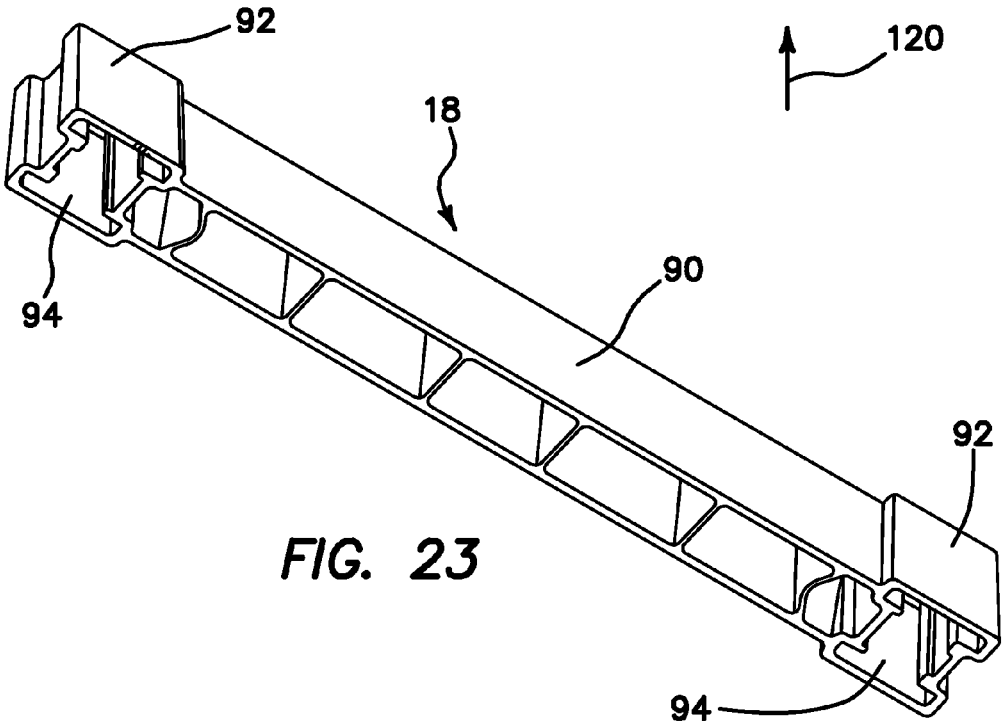
FIG. 23 is a bottom perspective view of the top post connector shown in FIG. 21.

The top post connectors 18 are shown in greater detail in FIGS. 20, 21, and 23. Each top connector 18 comprises a straight rectangular shaped connector piece 90 with a top cap 92 disposed at both ends. Each top cap 92 is substantially wedged shaped as seen in FIG. 21, that is the top portion of the top cap 92 is narrower in width than the width of the bottom portion of the top cap 92. Both the straight connector piece 90 and top caps 92 are hollow with their bottom surfaces open as seen in FIG. 23. Each top cap 92 includes a double I-beam shaped aperture 94 that is sized and shaped to fit the corresponding double I-beam cross section configuration of each primary post 12 seen previously in FIG. 5B as well as a wedge 96 depicted in FIG. 17.

Figure 17:
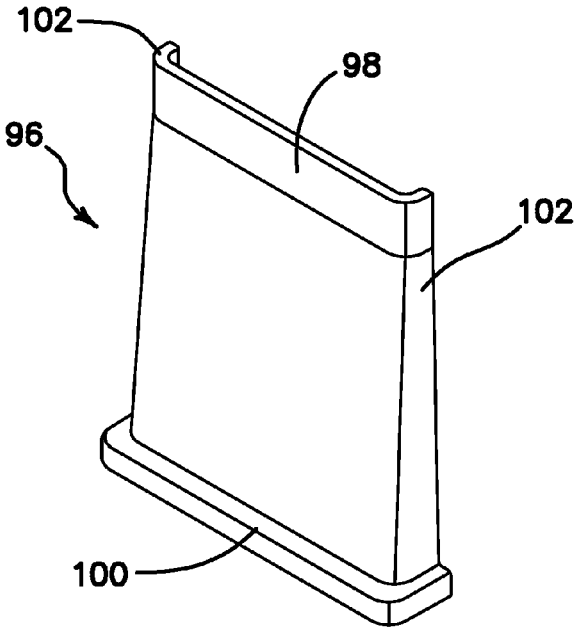
FIG. 17 is a perspective view of a wedge component of the shelving system.
Figure 18:
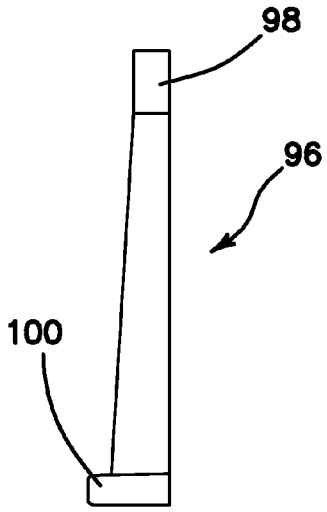
FIG. 18 is a side plan view of the wedge component shown in FIG. 17.
Figure 30:
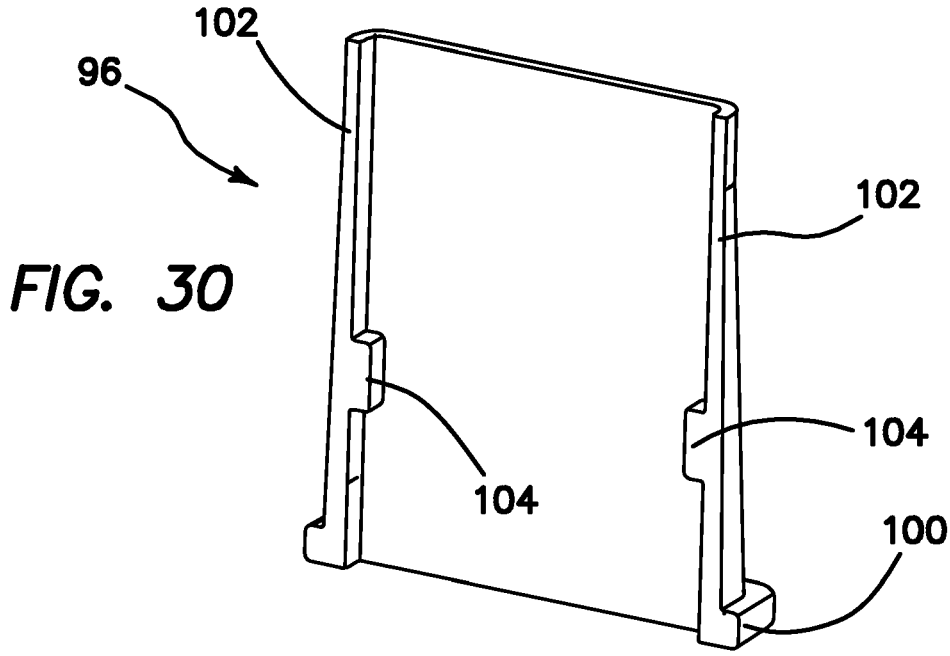
FIG. 30 is a perspective view of the reverse side of the wedge component shown in FIG. 17.

The wedge 96, as seen in FIGS. 17, 18, and 30, is substantially tapered in both length and width. In other words, the wedge 96 is shorter and narrower at its peak 98 than it is at its foot 100 as seen in the views of both FIGS. 17 and 18. The lateral edges of the wedge 96 are sufficiently curved inward so as to form a curved surface 102 on either side. Disposed on the back side of each curved surface 102 is a wedge tab 104 seen in FIG. 30. The wedge tabs 104 are rectangular in shape and are substantially similar to those of tabs 70 of the bifurcated collar 50 disclosed above.

Figures 19A, 19B:
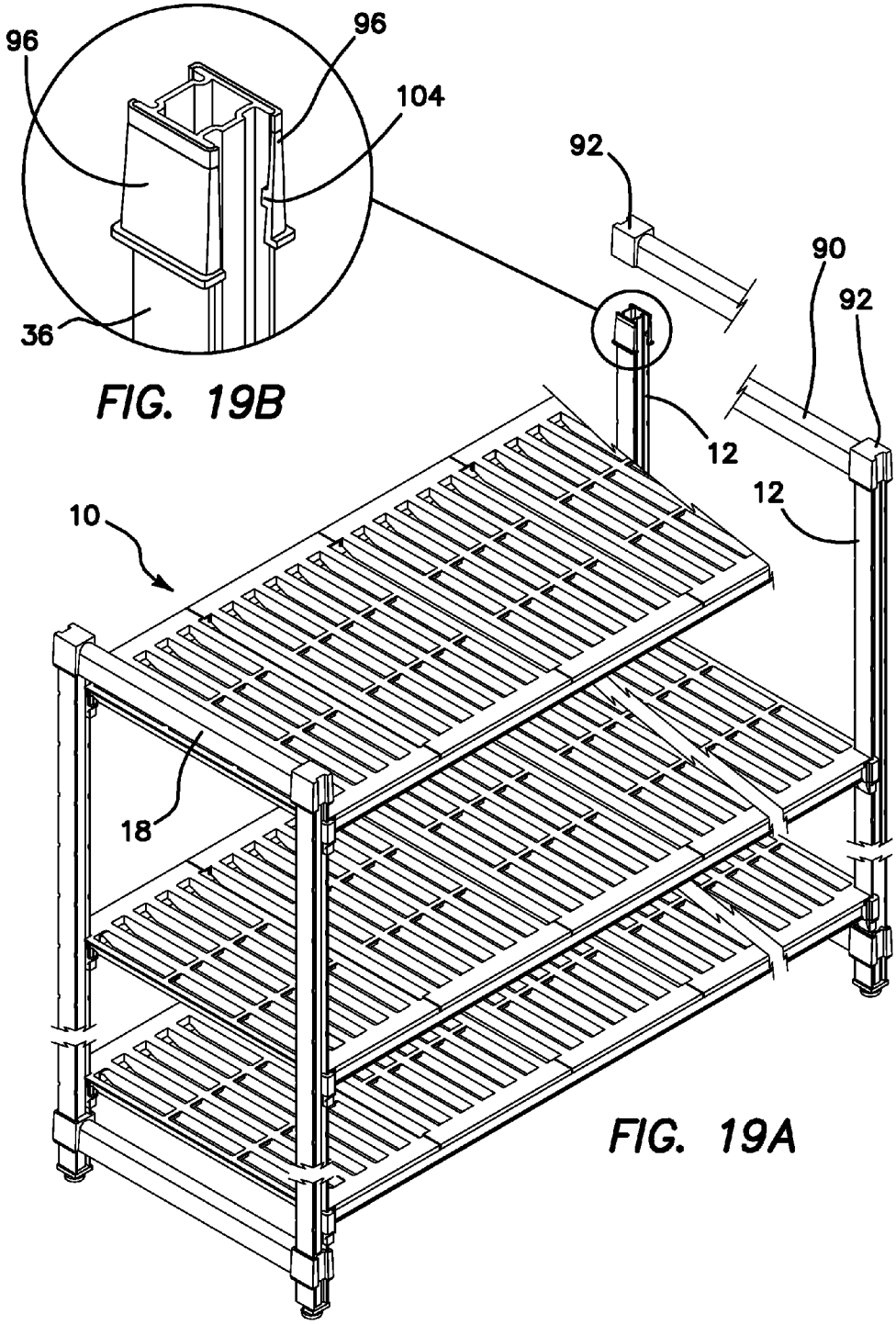
FIG. 19A is a truncated perspective view of the shelving system depicting the wedge component coupled to one of the plurality of vertical posts.
FIG. 19B is a magnified view of the coupling between the wedge component and the vertical post highlighted in FIG. 19A.

To couple the top post connectors 18 to the shelving system 10, a pair of wedges 96 are placed on the inner and outer surfaces 36, 38 of the primary posts 12, with one wedge 96 on each surface as seen in FIG. 19A and the magnified insert view of 19B. The pair of wedge tabs 104 disposed on each wedge 96 are inserted into the topmost pair of notches 48 defined within the primary posts 12 as seen in FIG. 19B. While the wedges 96 are held in place, the top post connector 18 is then slid down on top of the wedge 96 and primary post 12. The aperture 94 in each top cap 92 fully accommodates the wedge 96 and the double I-beam cross section of the primary post 12 as it slides down onto them. Due to the tapered or wedged shapes of the top caps 92 and the corresponding wedges 96, a substantial force is created on both wedges 96 as the top caps 92 are slid down, pushing them into the primary post 12. The net effect then is a squeezing coupling force similar to that utilized in the two halves 52, 54 of the bifurcated collar 50 disclosed above which produces an increasingly larger force directed towards the center of the post 12 as the top connector 18 is further forced into position. This inward force thus creates a corresponding and equal reactive outward force which keeps both the wedges 96 and top connector 18 firmly locked into position. This process may be repeated for the other top cap 92 of the top connector 18, or both top caps 92 may be positioned contemporaneously between two primary posts 12. Another top connector 18 is then positioned at the opposite lateral end of the shelving system 10 thus forming a rigid rectangular frame as seen in FIGS. 1 and 19A.

Figure 22:
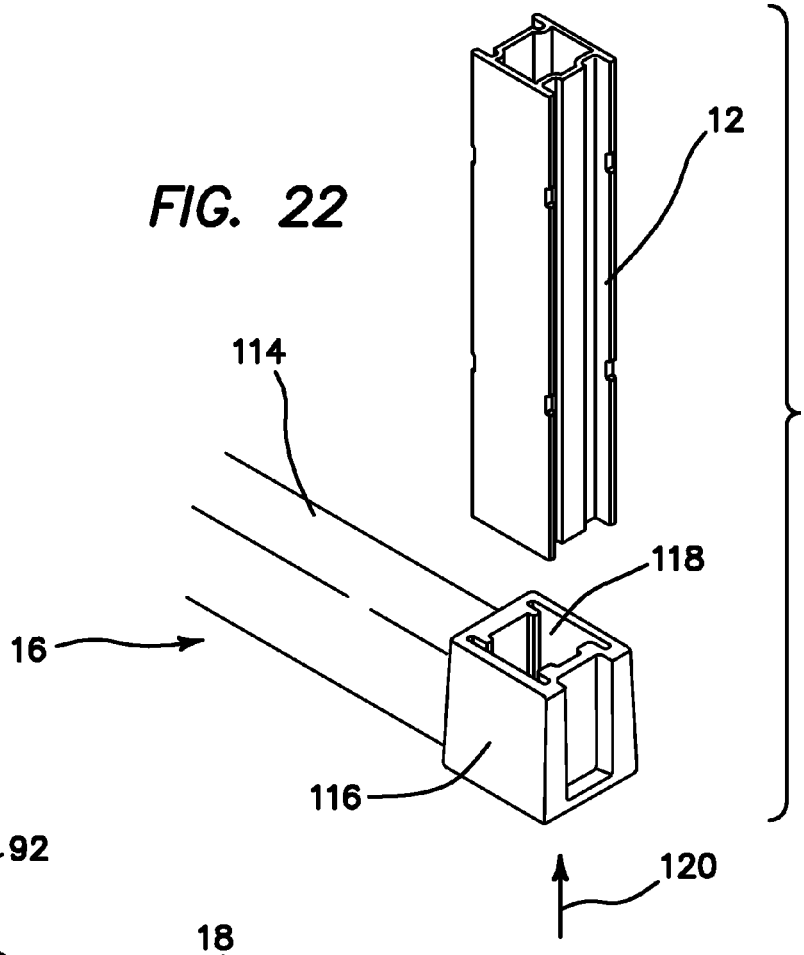
Figure 33:
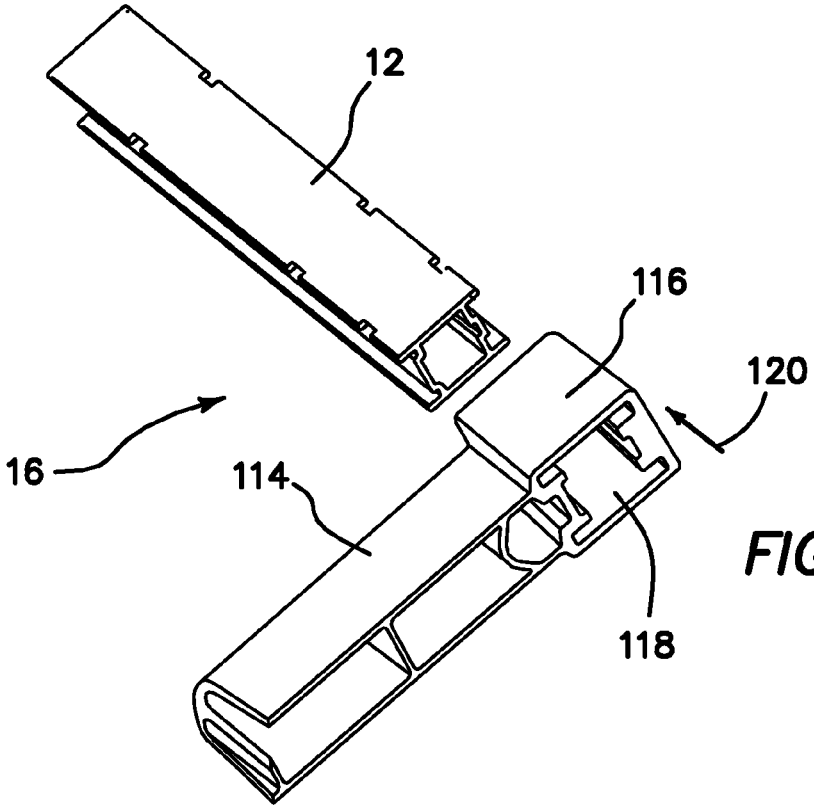
FIG. 33 is a bottom perspective view of the bottom post connector and its orientation to that of the vertical post in which it is coupled to shown in FIG. 22.

A similar process is present for applying the bottom post connector 16 to the shelving system 10 as seen in FIGS. 22 and 33. Like the top post connector 18, the bottom post connector 16 comprises a straight connector 114 with a bottom cap 116 disposed at either end. Each bottom cap 116 comprises a substantially double I-beam shaped aperture 118 defined through its volume. Unlike the corresponding top caps 92 however, the aperture 118 is defined in both the top and bottom surfaces of the bottom cap 116 as seen in FIGS. 22 and 33 respectively. To couple the bottom post connector 16, each bottom cap 116 is slid over the primary posts 12 in the direction represented by vector 120. The bottom cap 116 is slid up the primary posts 12 until it is at the desired height as determined by the user. Once at the proper height, a pair of wedges 96 as disclosed above are slid in between the bottom caps 116 and primary post 12 until the wedge tabs 104 enter the selected pair of notches 48 in the primary post. Due to the tapered or wedged shapes of the bottom caps 116 and the corresponding wedges 96, a substantial force is created on both wedges 96 as the wedges 96 are slid up, pushing them into the primary post 12. The net effect then is a squeezing coupling force similar to that present in the two halves 52, 54 of the bifurcated collar 50 disclosed above which produces an increasingly larger force directed towards the center of the post 12 as the bottom connector 16 is pushed further into position. This inward force thus creates a corresponding and equal reactive outward force which keeps both the wedges 96 and bottom connector 18 firmly locked into position. This process may be repeated for the other bottom cap 116 of the bottom connector 16, or both bottom caps 116 may be positioned contemporaneously between two primary posts 12. Another bottom connector 16 is then positioned at the opposite lateral end of the shelving system 10 thus forming a completed rigid parallelepiped as seen in FIGS. 1 and 19A.

Figure 34:
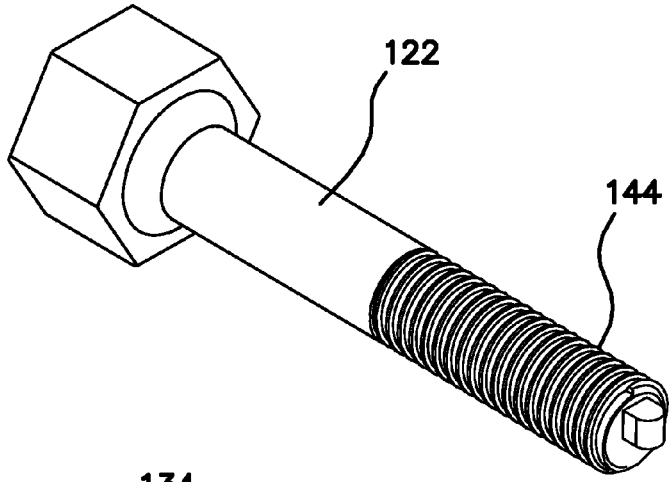
FIG. 34 is a perspective view of the leveling bolt of the shelving system.
Figure 35:
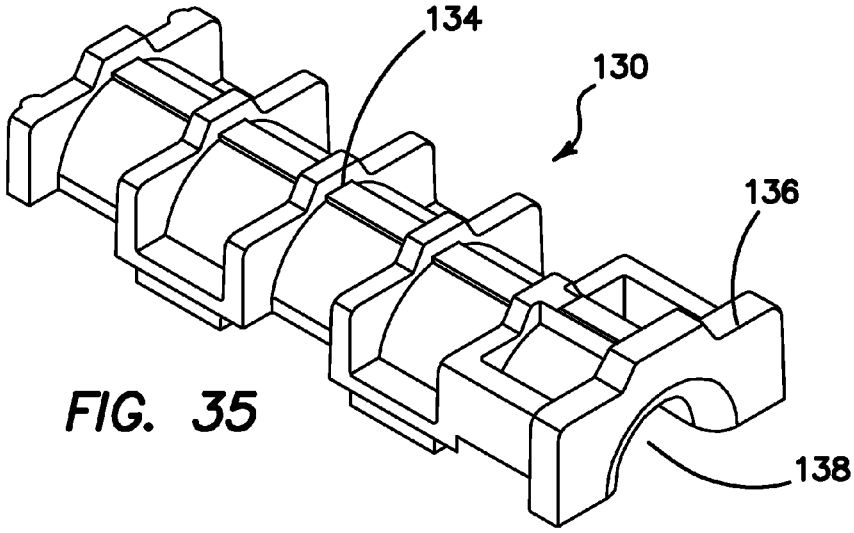
FIG. 35 is a perspective view of the left half of the foot insert of the shelving system.
Figure 36:
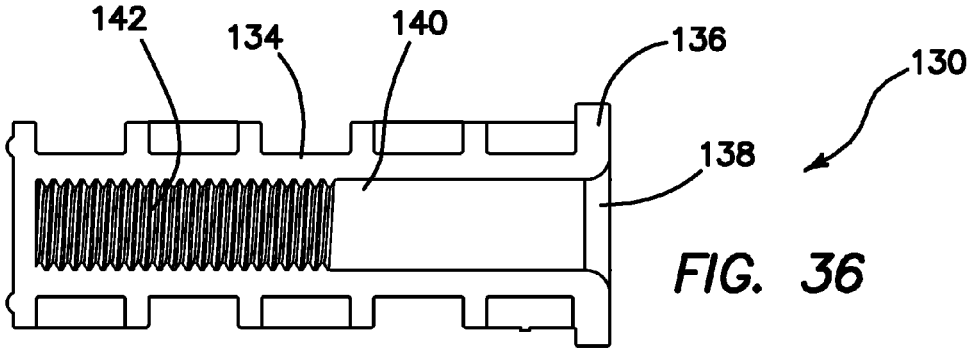
FIG. 36 is a bottom plan view of the left half of the foot insert shown in FIG. 35.
Figure 37:
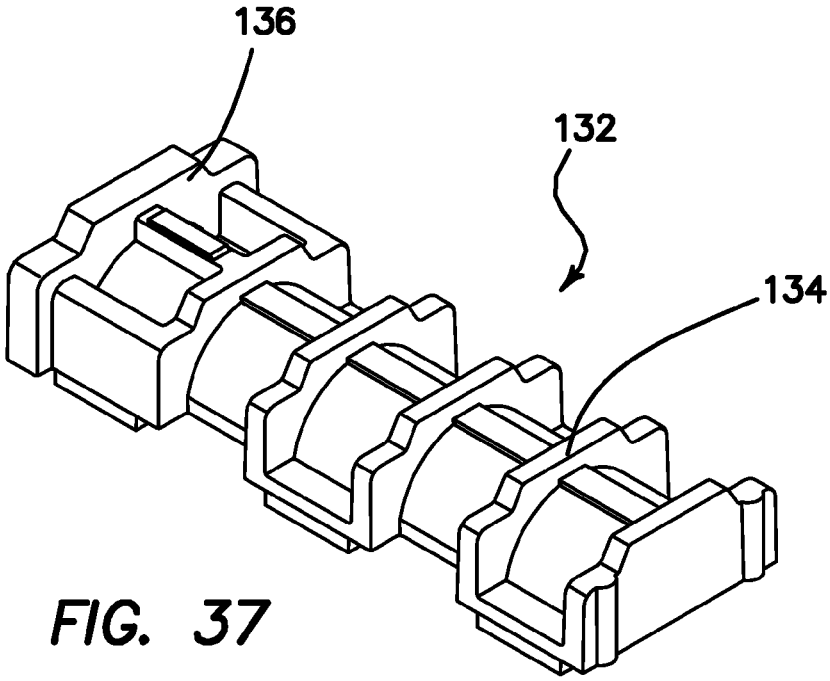
FIG. 37 is a perspective view of the right half of the foot insert of the shelving system.
Figure 38:
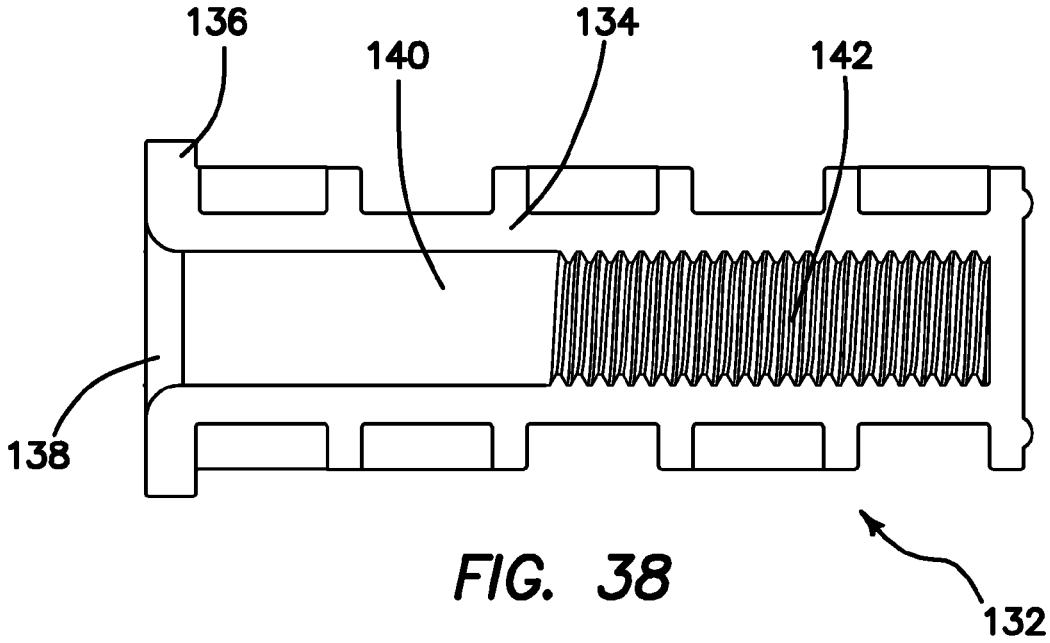
FIG. 38 is a bottom plan view of the right half of the foot insert shown in FIG. 37.

In one embodiment of the shelving system 10, the system 10 comprises a means for maintaining a level footing through a bifurcated foot insert 124 shown in FIGS. 35-38 and a leveling bolt 122 shown in FIG. 34. The leveling bolt 122 is similar to many bolts found in the art and comprises a male thread 144 on its distal portion as seen in FIG. 34. The bifurcated foot insert 124 is comprised of two halves, namely half "A" 130 seen in FIGS. 35 and 36, and half "B" 132 seen in FIGS. 37 and 38. Each half 130, 132 comprises a body portion 134 and a base portion 136 disposed at one end. Defined within the base portion 136 is a semi-circular shaped base aperture 138. The semi-circular shaped definition that starts at the base portion 136 with the base aperture 138 extending through the longitudinal length of each half 130, 132 to form a semi-cylindrical inner half-bore 140. At the distal end of the inner bore 140 is a female thread 142 defined within its surface.

Each half 130, 132 of the bifurcated foot insert 124 are mirror images of each other. That is to say, when half "A" 130 and half "B" 132 are brought together with their undersides facing each other as seen in FIG. 24, they form a complete piece with the semi-cylindrical inner half-bore 140 thus becoming a full cylindrical bore into which the leveling bolt 122 may be disposed.

To couple the bifurcated foot insert 124 into the shelving system 10, each half 130, 132 of the foot insert 124 is slid into the hollow cavity 44 of each primary post 12. Each half 130, 132 is inserted into the primary posts 12 such that each corresponding female thread 142 defined within the inner half-bore 140 of each half 130, 132 faces each other. Once properly positioned, the leveling bolt 122 is then inserted into the now fully circular base aperture 138 of the foot insert 124. The bolt 122 is pushed through the mated inner half-bores 140 until meeting the female thread 142. The bolt 122 is then rotated so that the male threads 144 on the distal end of the bolt 122 engage the female threads 142 defined within the mated inner half-bores 140 of the foot insert 124. With the male threads 144 and female threads 142 engaged, the bolt 122 is free to move distally and proximally throughout the foot insert 124 by the corresponding rotation of the bolt 122. The same process of foot insert 124 installation is repeated for as many posts 12 as are present within the shelving system 10.

By rotating one or more of the leveling bolts 122 within the system 10, the entire height of the system 10 may be adjusted according to the desires of the user according to the length of bolt 122 which is left to extend out of aperture 138. Alternatively, if one post 12 with the foot insert 124 and bolt 122 installed is placed over an uneven portion of ground or flooring, that particular bolt 122 may be adjusted so as to match the same height as the rest of the posts 12 present within the system 10. The foot inserts 124 and leveling bolt 122 are used to thus help ensure that the traverses 14 and shelves 22 as a whole are horizontal or adjusted to the desired inclination and therefore best suited for supporting large amounts of load.

Figure 24:
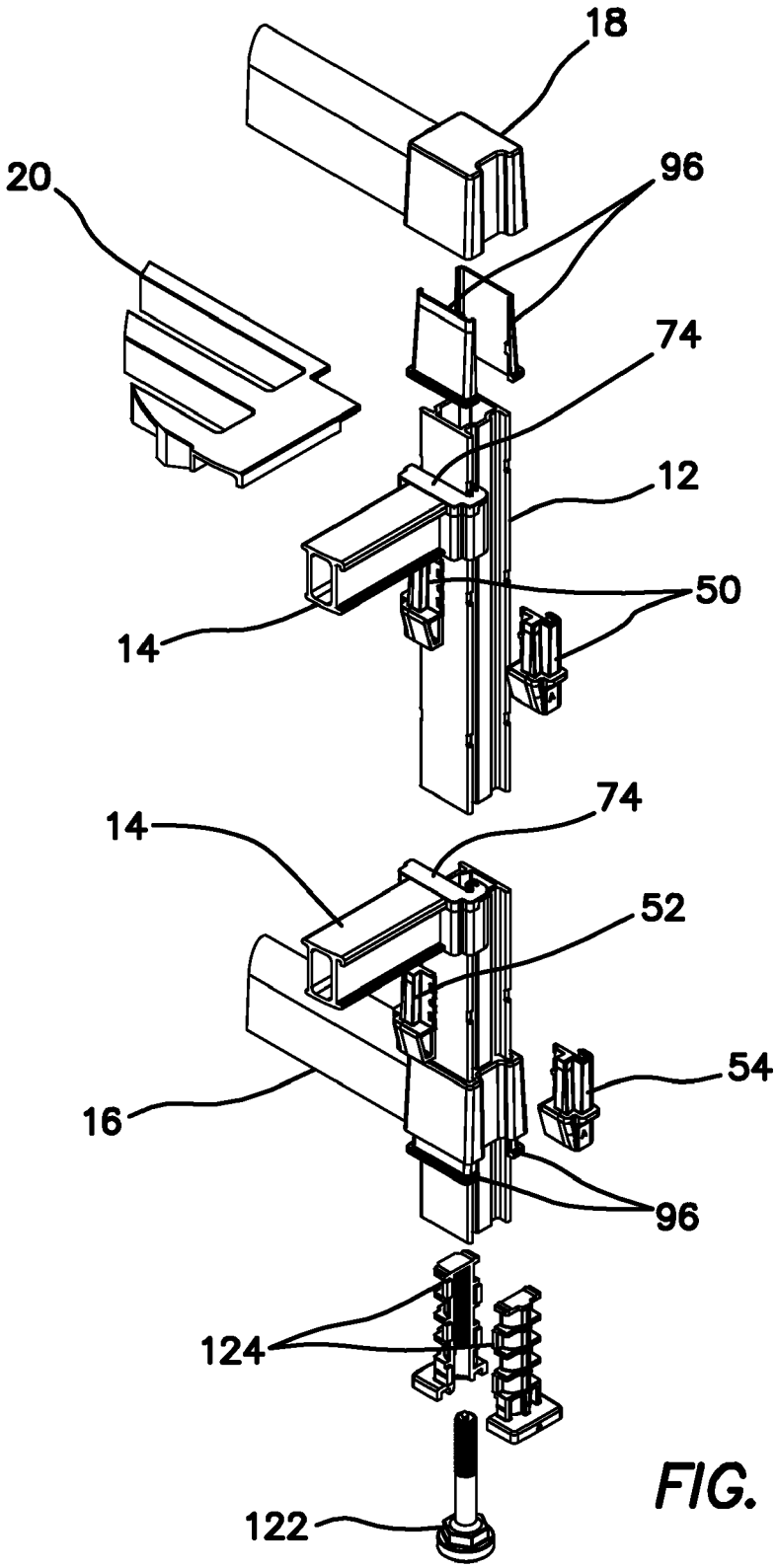
FIG. 24 is an exploded view of one of the plurality of vertical posts and the various components that may be coupled to it.

A summary of the components described above and their overall orientation in relation to forming the shelving system 10 is presented in the exploded view of FIG. 24. Starting at the bottom of the primary post 12 with the leveling bolt 122 and bifurcated foot insert 124. The bifurcated foot insert 124 comprises two mirror image halves 130, 132 that are inserted into the bottom of the posts 12 with the leveling bolt 122 in turn inserted into the foot insert 124. Above the foot insert 124 is the bottom post connector 16 with its corresponding wedges 96. Next along the post 12 are the plurality of traverses 14 which support the shelf plates 20 and which are coupled to the post 12 via the traverse end piece 76 and the two halves 52, 54 of the bifurcated collar 50. Two traverses 14 are shown as being coupled to the post 12 in FIG. 24; however fewer or additional traverses 14 may be coupled to the post 12 without departing from the original spirit and scope of the invention. After the plurality of traverses 14, the last component coupled to the post 12 is the top post connector 18 and its corresponding wedges 96. It is to be expressly understood that a substantially similar configuration is present on each of the posts 12 present in the shelving system 10 and that the configuration shown in FIG. 24 is for illustrative purposes only.

The configuration of the shelving system 10 as seen in FIG. 1 is an example of a "primary module" of the shelving system 10. That is to say, the primary module must contain at least four primary posts 12 arranged in a substantially rectangular configuration with at least one pair of parallel traverses 14 coupled laterally between the primary posts 12. Also the primary module of the shelving system 10 must comprise at least two top post connectors 18 and at least two bottom post connectors 16 coupled perpendicularly between the primary posts 12. For purposes of definition, whenever "primary module" is discussed herein, the basic configuration described above should be understood. As disclosed above, the primary module may contain fewer or additional shelf plates 20 or shelves 22 in general that what is shown in FIG. 1 without changing the basic meaning of this definition.

Figure 40:
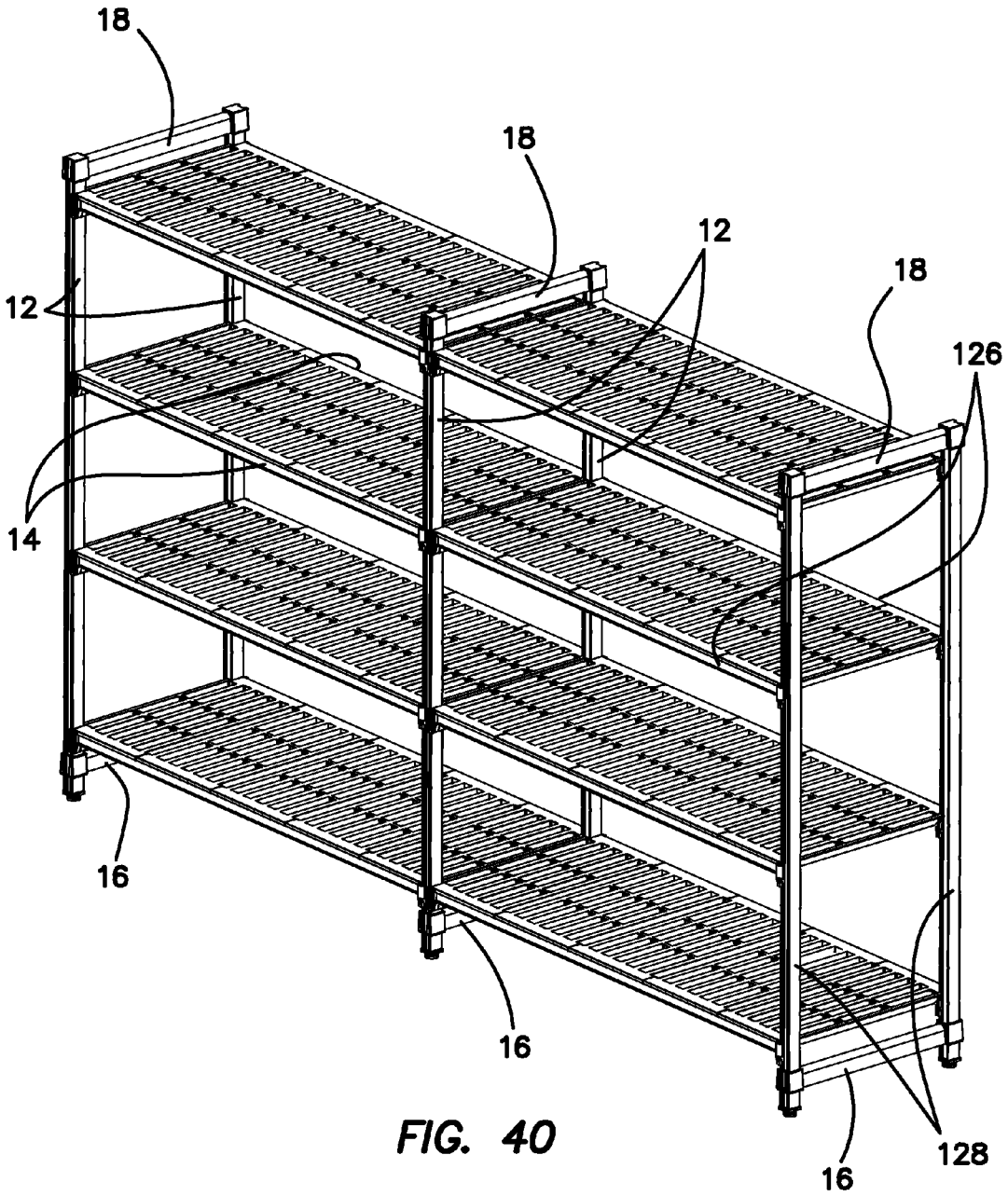
FIG. 40 is a perspective view of an alternative embodiment of the shelving system shown in FIG. 1 with the shelving system extended laterally.

In another embodiment, the shelving system 10 may be expanded in either lateral direction ad infinitum according to the desires of the user. For example, in the embodiment of the shelving system 10 shown in FIG. 1, another plurality of secondary horizontal traverses 126 may be coupled in parallel to the opposing surface of the primary posts 12 to that of the primary traverses 14. In other words, if the primary traverses 14 are coupled in parallel to the inner surface 36 of the primary posts 12, the secondary traverses 126 would be coupled in parallel to the outer surface 38 (or vice versa) of the same primary post 12 as seen in FIG. 40. The user may couple any number of pairs of secondary traverses 126 to the primary post 12 and is not constrained in any way to couple the same number of secondary traverses 126 to the primary post 12 as there are primary traverses 14. The user may also couple the secondary traverses 126 at any height along the primary post 12, regardless of the positions of the primary traverses 14.

Coupled to the opposing ends of the secondary traverses 126 is at least another pair of vertical posts, namely secondary posts 128 as seen in FIG. 40. The secondary traverses 126 are coupled to the primary posts 12 and the secondary posts 128 by the same means of the bifurcated collar 50 and traverse end pieces 76 described above.

It is this configuration seen in FIG. 40, namely at least two posts coupled to at least one parallel pair of traverses which are in turn then coupled to at least two other posts of a differing module, which comprises a "secondary module." The secondary module may in turn then have any number of additional secondary modules coupled to it in series with the pair of parallel traverses coupled to the posts of the previous secondary module coupled before it. It is in this fashion, namely the capability for any number of secondary modules being linked together in series, that the shelving system 10 becomes scalable and extendedable in one or more lateral directions for as far as the user desires. For purposes of definition, whenever "secondary module" is discussed herein, the basic configuration described above should be understood. As disclosed above, the secondary module may contain fewer or additional shelf plates 20 or pairs of parallel secondary traverses 126 in general that what is shown in FIG. 40 without changing the basic meaning of this definition. It should also be pointed out that the exact orientation of the secondary module with respect to the primary module may also be different from what is shown in FIG. 40. For example the secondary module may be coupled to the primary module along the same longitudinal axis as the primary module as is shown. However it may also be coupled to the primary module so that the longitudinal axis of the secondary module is orientated anywhere from 0-180° with the respect to the longitudinal axis of the primary module by use of appropriate couplings or connectors, some embodiments of which are discussed below.

In yet another embodiment, the shelving system 10 is scalable and extendable in a direction perpendicular to the longitudinal axis of the primary module or to the preceding secondary module.

Figure 25:
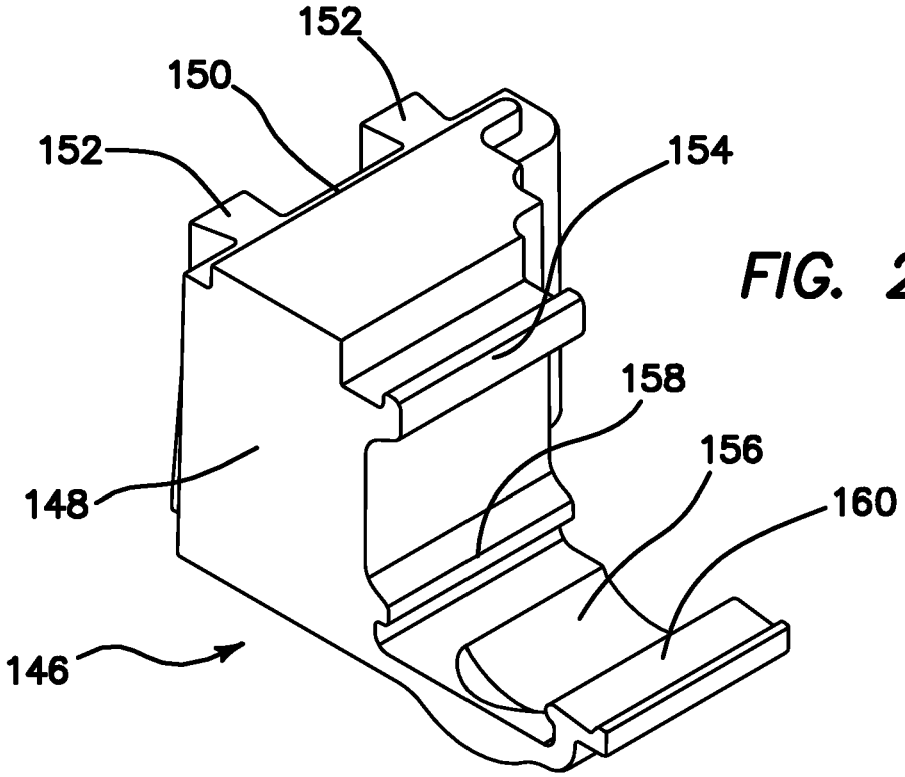
FIG. 25 is a perspective view of the corner connector of the shelving system.
Figure 26:
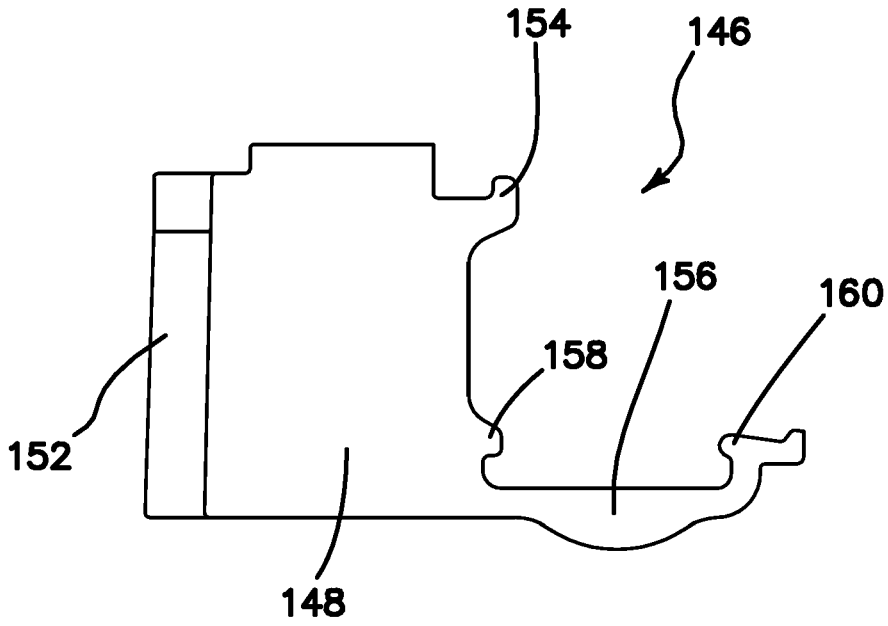
FIG. 26 is a side plan view of the corner connector shown in FIG. 25.
Figure 27:
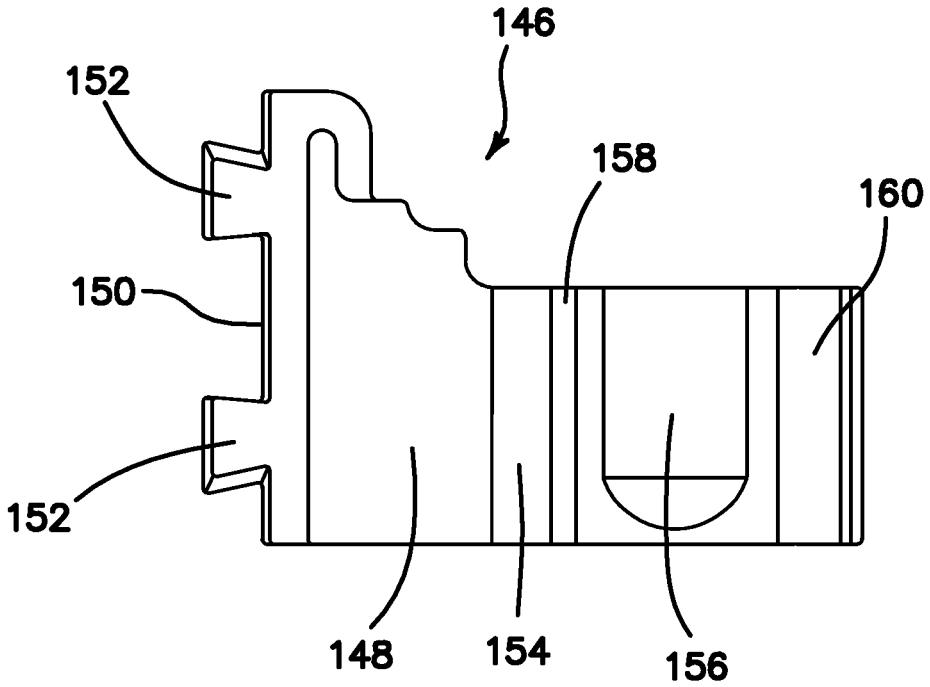
FIG. 27 is a top plan view of the corner connector shown in FIG. 25.

The shelving system 10 is perpendicularly scalable by use of a corner connector 146 shown in FIGS. 25-27. The corner connector 146 comprises a main body 148 and a face 150 disposed on the main body 148. The face 150 comprises a pair of male components 152 defined onto its surface. The pair of male components 152 are identical to the male dovetailed components 56 disposed on each half 52, 54 of the bifurcated collar 50, namely they are substantially dove-tailed shaped in both dimensions of width and length as best seen in FIGS. 26 and 27. Disposed on the opposing side of the main body 148 opposite to that of the face 150 is an upper lip 154 and a lower lip 156 best seen in FIG. 26. The upper lip 154 is shaped so as to substantially form a hook across the width of the corner connector 146 as seen in FIG. 25. The lower lip 156 itself comprises an outer ridge 158 and inner ridge 160 disposed at either lateral edge of the lower lip 156.

In order to couple the corner connector 146 to the shelving system 10, the outer ridge 158 of the lower lip 156 is placed underneath the bottom surface 26 of any traverse 14 within the shelving system 10 at any point along its length that the user desires. The extended segment 34 of the traverse 14 shown in FIG. 4 is then inserted into the space defined between the outer ridge 158 and the main portion of the lower lip 156. At the same time, the upper lip 154 is inserted into the space defined between the lip 32 and corresponding side wall 28 of the traverse 14 also shown in FIG. 4. The corner connector 146 is then rotated about the traverse 14 until the inner ridge 160 snaps around the opposing or "inner" edge of the bottom surface 26. The entire width of the bottom surface 26 of the traverse 14 is now contained within the bottom lip 156 of the corner connector 146 with the upper lip 154 also snuggly fit into the interior of the lip 32 of the traverse 14.

Figure 28:
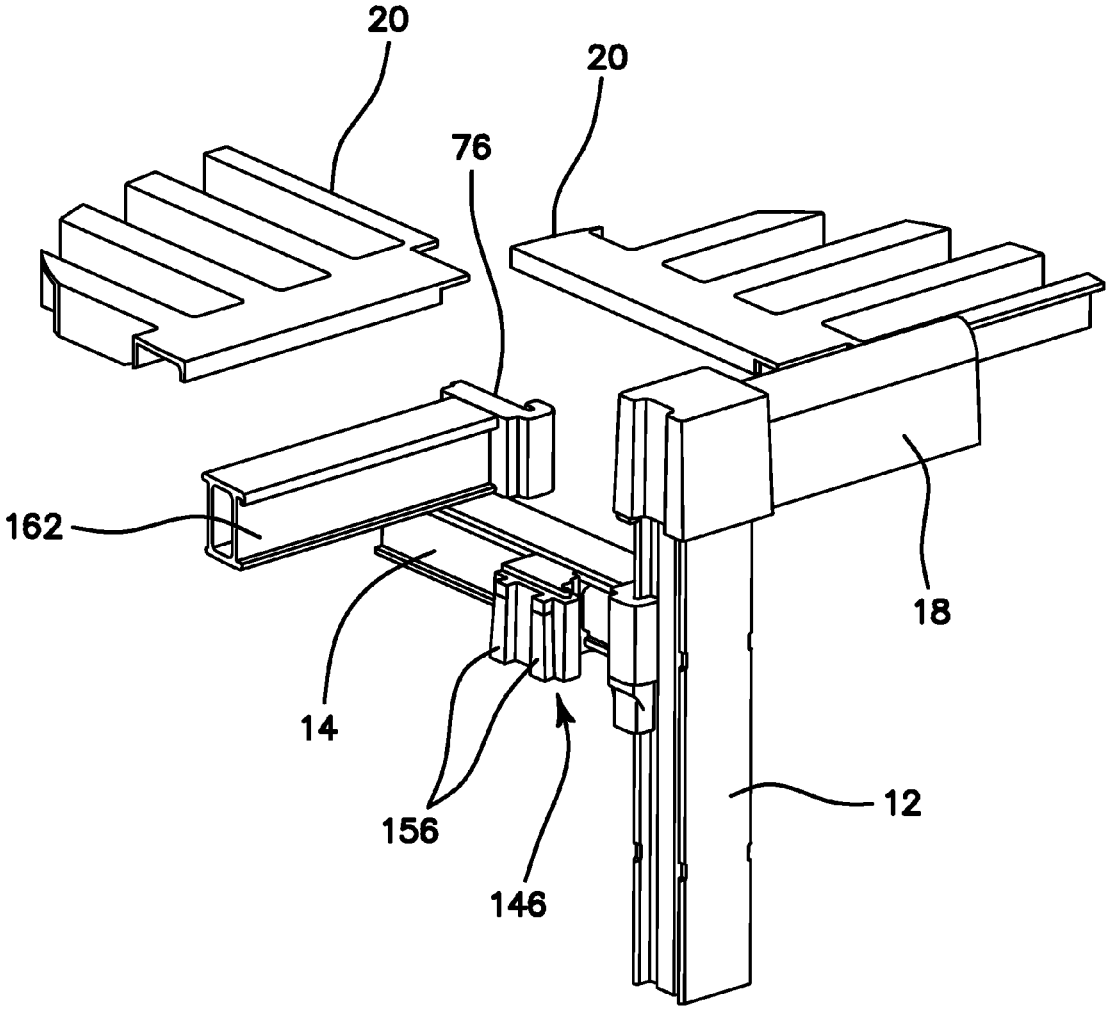
FIG. 28 is an exploded view of the corner connector and other related components used to couple a secondary traverse to the primary traverse.
Figure 29:
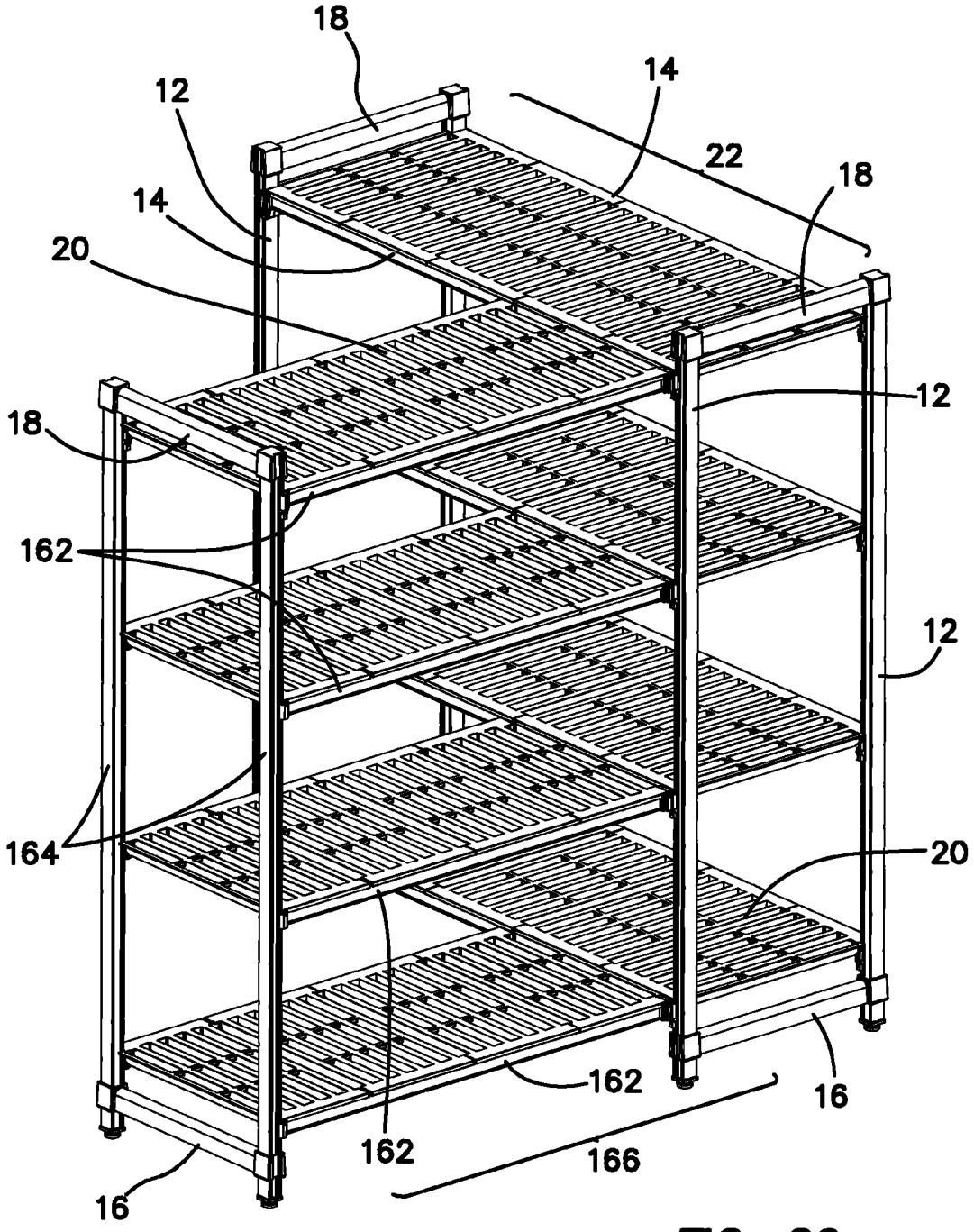
FIG. 29 is a perspective view of an alternative embodiment of the shelving system wherein a secondary module is coupled perpendicularly to the primary module.
Figure 39:
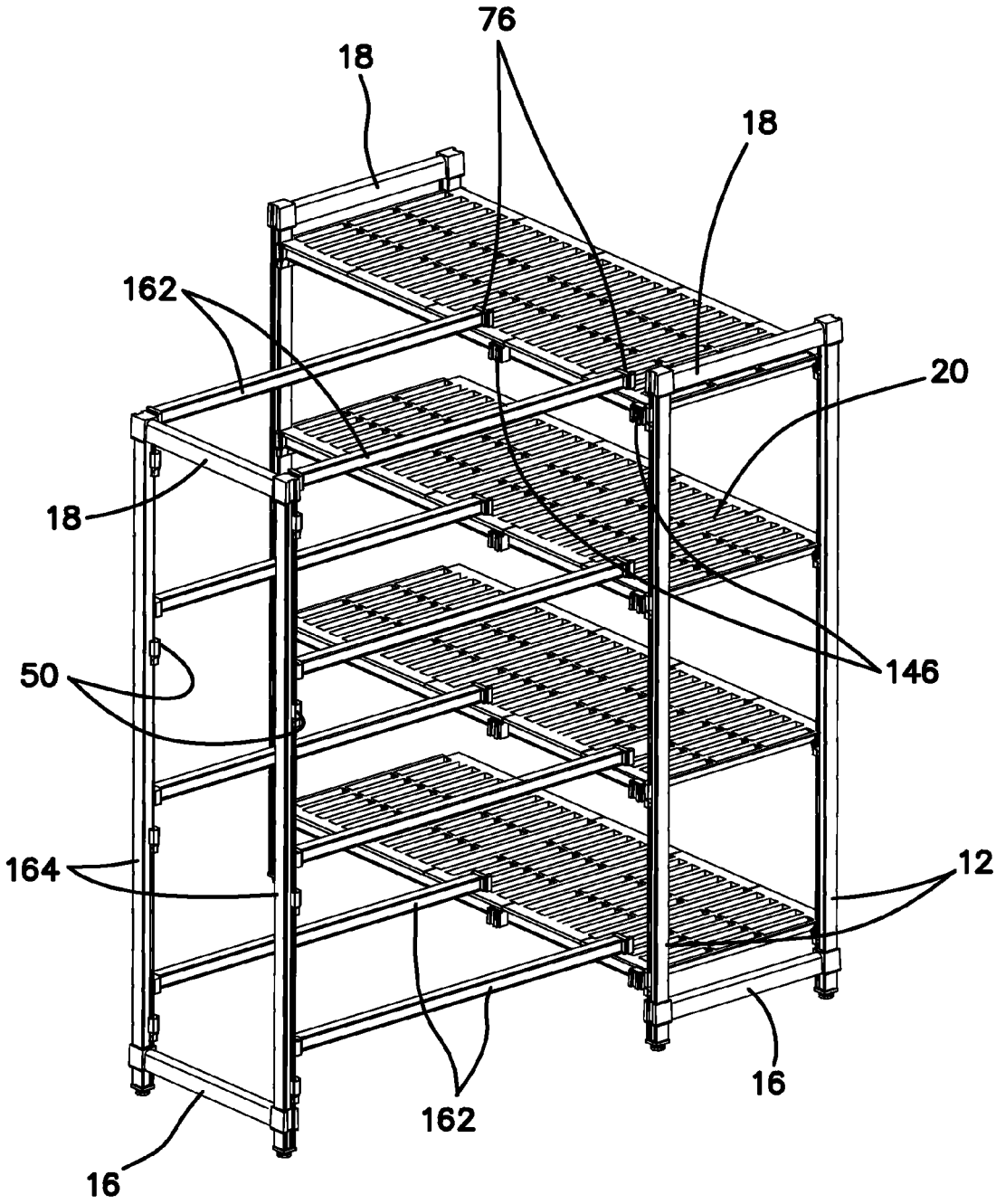
FIG. 39 is an additional perspective view of the alternative embodiment of the shelving system shown in FIG. 29 wherein the shelf plates of the secondary module coupled perpendicularly to the primary module are removed.

With the corner connector 146 firmly coupled to the traverse 14, the face 150 of the corner connector 146 is exposed "outward" or to the "outside" of the shelving system 10, namely on the opposite side of the traverse 14 that comprises the shelf plates 20 as seen in FIG. 28. An orthogonal or normal traverse 162 with a traverse end piece 76 coupled to its end may then itself be coupled to the corner connector 146 and the male lip 156 disposed thereon by the same process described above with respect the traverse end piece 76 and bifurcated collar 50. The orthogonal traverse 162, when coupled to the shelving system 10, is in a direction normal or perpendicular to that of the original primary traverses 14. The opposing end of the normal traverse 162 may then be coupled to an auxiliary vertical post 164 as seen in FIGS. 29 and 39 by the same means of traverse end piece 76 and bifurcated collar 50 described above. This process may then be repeated in parallel so as to form a pair or a plurality of pairs of parallel normal traverses 162 as best seen in FIG. 39. A plurality of shelf plates 20 may then be placed on top of the pair of parallel normal traverses 162 thus forming a complete perpendicular shelf 166. Each pair of auxiliary posts 164 also comprises a bottom post connector 16 and a top post connector 18 as disclosed above so as to maintain the structural integrity of the perpendicular shelves 166.

It can be appreciated therefore that the configuration seen in FIGS. 29 and 39, namely at least two auxiliary posts 164 coupled to at least one parallel pair of normal traverses 162, which are in turn then coupled to at least one primary traverse 14, also constitutes a "secondary module." As discussed above, the secondary module coupled perpendicularly to the primary module may in turn then have any number of additional secondary modules coupled to it in series with the pair of parallel traverses coupled to the posts of the previous secondary module coupled before it. It is in this fashion, namely the capability for any number of secondary modules being linked together in series, that the shelving system 10 becomes scalable and may be extended in one or more perpendicular directions for as far as the user desires. As disclosed above, the secondary module may contain fewer or additional shelf plates 20 or pairs of parallel normal traverses 162 in general that what is shown in FIGS. 29 and 39 without changing the basic meaning of this definition.

In FIG. 29 it is shown that four perpendicular shelves 166, one for each corresponding primary module shelf 22 disposed between the primary posts 12, are coupled between the primary traverses 14 and a pair of auxiliary posts 164, however this example is for illustrative purposes only. It is to be expressly understood that fewer or additional perpendicular shelves 166 may be coupled to the shelving system 10 than what is shown and that the perpendicular shelves 166 may be coupled to the primary traverses 14 at any point along their length, not just at one of their extreme ends as seen in FIG. 29.

Figure 41:
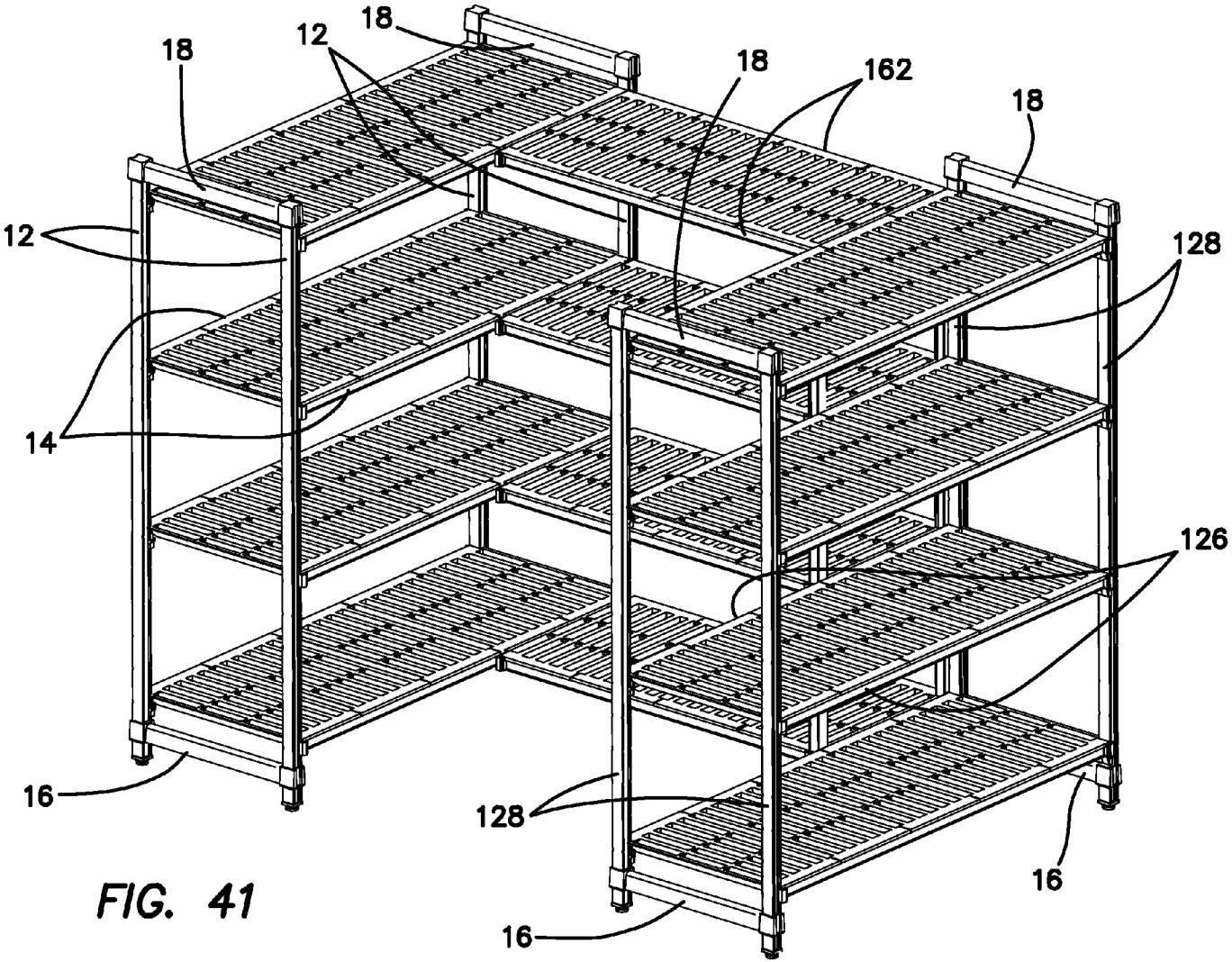
FIG. 41 is a perspective view of an alternative embodiment of the shelving system shown in FIG. 1 with the shelving system extended perpendicularly and laterally.
Figure 42:
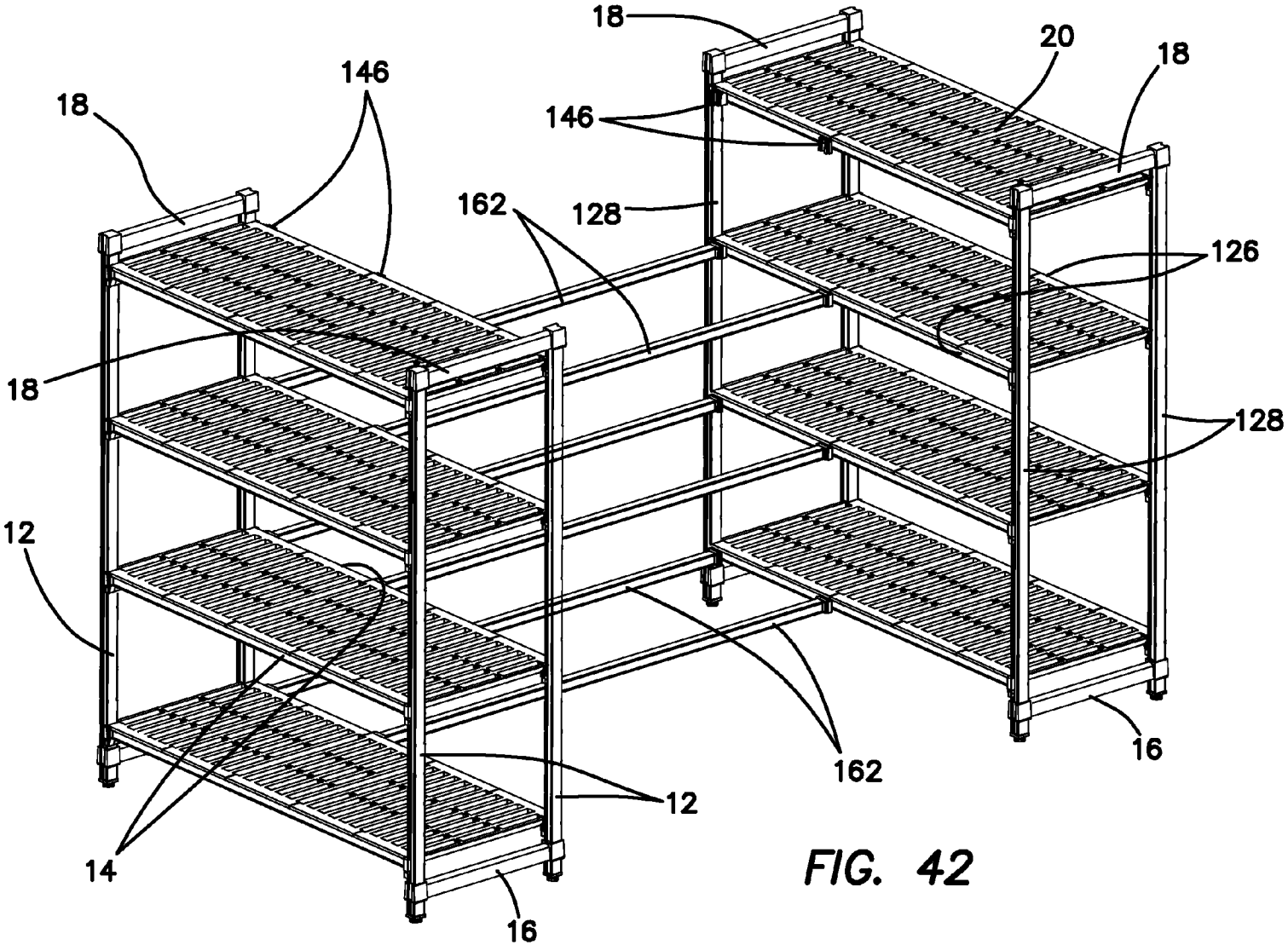
FIG. 42 is an additional perspective view of the shelving system shown in FIG. 41 wherein the shelf plates of the secondary module coupled perpendicularly to the primary module are removed.

In yet another embodiment, the shelving system 10 is scalable and extendable in both the lateral and perpendicular directions for as long as the user desires. For example, as seen in FIGS. 41 and 42, the shelving system 10 can be configured with both a plurality of secondary traverses 126 and posts 128 as well as normal traverses 162. Additional auxiliary posts 164 not seen in FIGS. 41 and 42 may also be included within the shelving system 10 configurations. In other words, a single primary module may have multiple secondary modules coupled to it with each secondary module being coupled at differing orientations to each other and to the primary module. It is therefore to be expressly understood that the configuration shown in FIGS. 41 and 42 is not meant to be limiting in any way and that any number of configurations not shown may also be used without departing from the original spirit and scope of the invention. It is an objective of this embodiment to provide the user with a shelving system 10 that may be scalable in an ad hoc fashion, namely that the shelving system 10 may extended in multiple directions at will according to the present needs and conditions of the user. Even using only combinations of perpendicular connectors, a large number of complex and arbitrarily configured rigid and high load bearing shelving systems 10 can be readily configured by the user.

Hence, it is expressly understood that in the same manner as described in connection with the orthogonal connector 146, connectors capable of providing other angles of connection can also be provided according to the teachings of the illustrated embodiments of the invention without departing from its spirit and scope. For example, it is clear according to the present teachings, that a connector analogous to that shown for connector 146 could be provided to allow shelf connections at 30°, 45°, 60° or other angulations by molding an angled connector having the appropriate relative angular orientations of face 150 with respect to the lips 154 and 156 and ridges 158 and 160. In such instances appropriately shaped shelf plates 20 and appropriately sized lengths of traverses 14 would also be provided corresponding to each angulation. Further, connector 146 could be provided with a vertical hinge between face 150 on one hand and lips 154 and 156 and ridges 158 and 160 on the other hand to allow for arbitrary angulation. In such a case traverse 14 would also be telescopic so that its length could be arbitrarily adjusted according to the angulation chosen by the user or installer of shelving system 10 and shelf plates 20 would be configured to be readily cut to shape.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following invention and its various embodiments.

Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the invention is explicitly contemplated as within the scope of the invention.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

We claim:

1. A shelving system comprising:

a plurality of vertical posts having a pair of edges with a plurality of notches defined in each edge disposed in the corner positions of a substantially rectangular shape; and a plurality of horizontal traverses disposed between the plurality of vertical posts and wherein the traverses are coupled to the vertical posts in parallel pairs, wherein the plurality of horizontal traverses are coupled to the plurality of vertical posts by means of a bifurcated collar disposed between the plurality of traverses and coupled to the plurality of posts, the bifurcated collar comprising two halves, each half comprising at least one substantially dove-tailed shaped male component disposed thereon, and a traverse end piece coupled to each horizontal traverse, the traverse end piece comprises a head portion with at least two substantially dove-tailed female apertures defined therein sized and shaped to accommodate and capture the at least one male component disposed on each half of the bifurcated collar wherein the traverse end piece further comprises a body portion which projects perpendicularly from said head portion, wherein the body is configured to receive a hollow cavity of one of the plurality of horizontal traverses, and wherein each bifurcated collar is separable into two halves, each half of the bifurcated collar comprising a tab capable of being inserted into one of the plurality of notches defined in one of the pair of edges of one of the plurality of vertical posts.

2. The shelving system of claim 1 further comprising a corresponding plurality of foot inserts coupled to the bottom of each of the plurality of vertical posts, wherein the foot inserts comprise means for raising and lowering the height of the vertical post it is coupled to.

3. The shelving system of claim 1 where the female apertures defined in the plurality of traverse end pieces and the at least one male component of each half of the bifurcated collars combine with each other to distribute a load placed on the plurality of horizontal traverses so that each half of each bifurcated collar is pushed toward each other and are squeezed around the corresponding one of the plurality of vertical posts to which the bifurcated collar is coupled.

4. The shelving system of claim 1 further comprising at least two top post connectors and at least two bottom post connectors coupled between the plurality of vertical posts at an orientation perpendicular or at an angle to that of the plurality of horizontal traverses.

5. The shelving system of claim 4 where the at least two top post connectors and at least two bottom post connectors each comprise a cap disposed at either end, each cap comprising an aperture sized to accommodate and capture the cross section of the vertical posts that the cap is coupled to along with at least two wedge components also coupled to the vertical post.

6. The shelving system of claim 5 where the apertures and the at least two wedge components disposed in each cap of the at least two top post connectors and the at least two bottom post connectors comprise complimentary tapered shapes which combine with each other to direct a downward force towards the center of the plurality of vertical posts when the downward force is placed on the at least two top post connectors or on the at least two bottom post connectors.

* * * * *